US007464766B2

(12) United States Patent
Crabtree et al.

(10) Patent No.: US 7,464,766 B2
(45) **Date of Patent: *Dec. 16, 2008**

(54) RANGER/HYBRID AUTOMATIC SELF-METERING NOZZLE, WITH RATIO-SELECTABLE AND FLOW METER FEATURES

(75) Inventors: Dennis W. Crabtree, Beaumont, TX (US); Dwight P. Williams, Vidor, TX (US)

(73) Assignee: Williams Fire & Hazard Control, Inc., Mauriceville, TX (US)

( * ) Notice: Subject to any disclaimer, the term of this patent is extended or adjusted under 35 U.S.C. 154(b) by 617 days.

This patent is subject to a terminal disclaimer.

(21) Appl. No.: 10/677,900

(22) Filed: Oct. 2, 2003

(65) Prior Publication Data

US 2004/0084192 A1 May 6, 2004

Related U.S. Application Data

(63) Continuation-in-part of application No. 09/284,561, filed as application No. PCT/US98/20061 on Sep. 25, 1998, now Pat. No. 6,749,027.

(51) Int. Cl.
*A62C 2/00* (2006.01)

(52) U.S. Cl. ..... 169/44; 169/14; 169/27; 239/413; 239/416.4; 239/417; 239/452; 137/98

(58) Field of Classification Search ..... 239/413, 239/416.4, 417.5, 453, 424, 514, 424.5, 419.5, 239/419, 417, 452, 451, 436, 305, 74; 169/44, 169/14; 137/114, 98

See application file for complete search history.

(56) References Cited

U.S. PATENT DOCUMENTS

| | | | | |
|---|---|---|---|---|
| 3,539,112 | A | 11/1970 | Thompson | |
| 3,647,002 | A * | 3/1972 | Lindsay | 169/16 |
| 3,684,192 | A | 8/1972 | McMillan | |
| 3,863,844 | A | 2/1975 | McMillan | |
| 4,224,956 | A * | 9/1980 | Klein | 137/114 |
| 4,497,442 | A | 2/1985 | Williams | |
| 4,805,700 | A * | 2/1989 | Hoover | 169/15 |
| 5,012,979 | A * | 5/1991 | Williams | 239/416.5 |
| 5,275,243 | A | 1/1994 | Williams et al. | |
| 5,312,048 | A * | 5/1994 | Steingass et al. | 239/441 |
| 5,678,766 | A * | 10/1997 | Peck et al. | 239/419 |
| 6,659,187 | B1 * | 12/2003 | Crabtree et al. | 169/44 |
| 6,749,027 | B1 * | 6/2004 | Crabtree et al. | 169/44 |
| 2006/0102749 | A1 * | 5/2006 | Crabtree et al. | 239/410 |

* cited by examiner

*Primary Examiner*—Dinh Q Nguyen
(74) *Attorney, Agent, or Firm*—Shaper Iler LLP; Sue Z. Shaper

(57) ABSTRACT

A self-metering, automatic (i.e. pressure regulating) industrial-scale fire fighting nozzle, with or without self-eduction, for self-metering a concentrate in accordance with varying liquid flow through the nozzle occasioned by the pressure regulating, with additional features of having a "ratio selectable" means for self-metering for different selected additive concentrations or mixing ratios and of having a mechanical flowmeter.

14 Claims, 18 Drawing Sheets

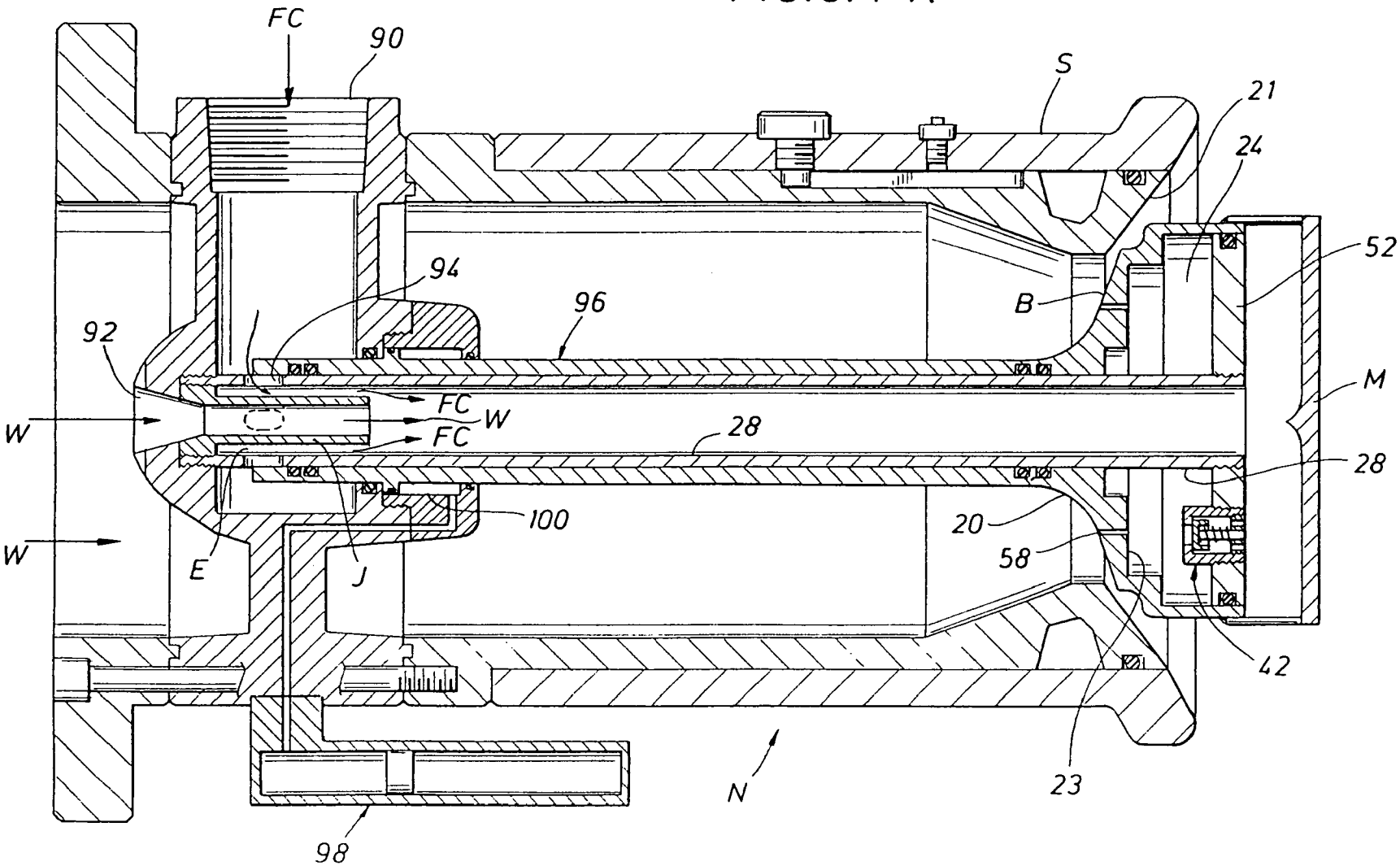
FIG. 3A-R

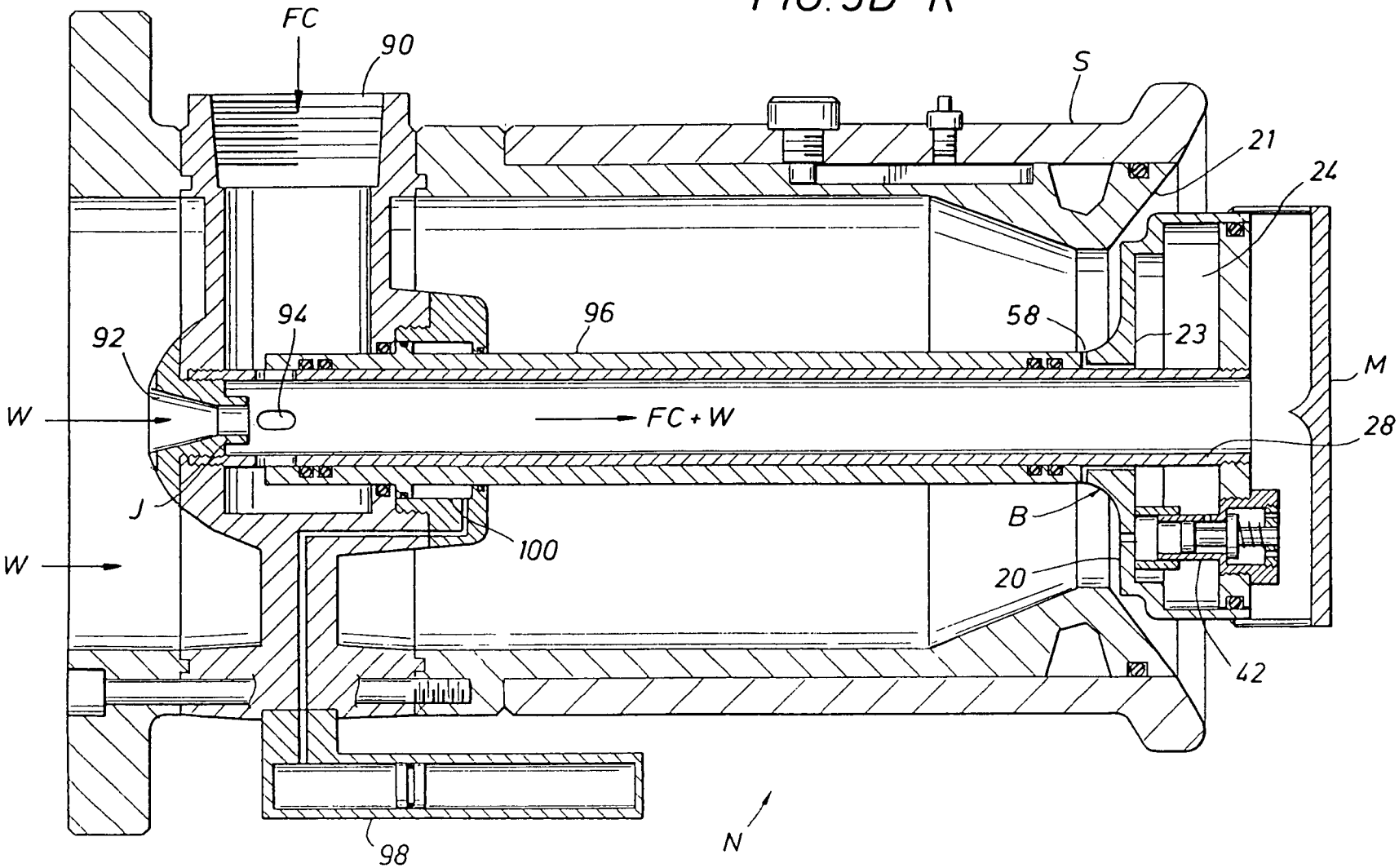
FIG. 3D-R

RANGER/HYBRID AUTOMATIC SELF-METERING NOZZLE, WITH RATIO-SELECTABLE AND FLOW METER FEATURES

CROSS REFERENCE TO RELATED APPLICATIONS

This application is a continuation-in-part of, and claims priority to: (1) application Ser. No. 09/284,561, filed Apr. 15, 1999, now U.S. Pat. No. 6,749,027, entitled Improved Fire Fighting Nozzle and Method Including Pressure Regulation, Chemical and Eduction Features, a U.S. National Stage application of PCT/US 98/20061, filed Sep. 25, 1998; and to (2) copending CIP application Ser. No. 10/380,750, filed Mar. 17, 2003, of same title, a U.S. National Stage application of PCT/US00/26568. application Ser. No. 09/284,561, referenced above, is hereby incorporated herein by reference in its entirety.

FIELD OF THE INVENTION

The instant invention relates to automatic (i.e. pressure regulating, at least in part) industrial-scale fire fighting foam nozzles, and in particular to a self-metering feature, a concentrate percent selectable feature and a mechanical flowmeter feature, the foam nozzle operable with and without self-eduction, and to related methods of use of such nozzles.

BACKGROUND OF THE INVENTION

The instant invention is directed to an improved, automatic (i.e. pressure regulating, at least in part) industrial-scale fire fighting foam nozzle, the foam nozzle operable with and without a self-eduction feature. Improved features include automatically self-metering concentrate into the flow of the primary fire-fighting fluid (typically water) as the flow rate varies, a feature made particularly pertinent by the automatic aspect of the nozzle. The flow rate in "automatic" (i.e. pressure regulating) nozzles varies significantly more than in "fixed flow" nozzles.

Improved features also include selective valving in order to automatically accommodate and self-meter for different additive concentration levels or "ratios" or percentages, as well as a mechanically operable flowmetering capability.

Terms

"Industrial-scale" as used herein refers to nozzles designed to fight industrial fires and indicates flow rates at least equal to 50 gpm, and which typically run to greater than 1000 gpm.

"Automatic" refers to a nozzle's capability, at least for a portion of its flow rate range, to automatically adjust the nozzle's discharge orifice in order to maintain (at least approximately) a targeted discharge pressure (and thus to tend to maintain a nozzle's range) when or while flow rates or pressures supplied to the nozzle vary.

"Self-metering" refers to an automatic nozzle's capacity to automatically adjust the amount of foam concentrate or additive pumped (whether or not by self-eduction, in whole or in part) into a nozzle's main stream of fire fighting fluid as flow rate of the primary fire fighting fluid through the nozzle varies. Self-metering, thus, targets maintaining a given ratio of concentrate or additive to fire fighting fluid as or while fire fighting fluid flow rate varies.

"Selectable" refers to a capacity to select one of a plurality of concentrate or additive ratios in order for the self-metering feature to then meter for this selected ratio.

"Self-eduction" refers to a jet pump type design, or eductor, built into or onto a nozzle such that a flow of the primary fire fighting fluid to and/or through the nozzle at least assists to draw or pump a foam concentrate or additive into the nozzle.

Background

Maintaining an approximately constant discharge pressure for a nozzle tends to yield a constant range and "authority" for the discharge from the nozzle. As a consequence, however, nozzle flow rate tends to vary significantly, reflecting rather directly variations in supply of fluid to the nozzle.

In certain applications, such as in vapor suppression, it is particularly useful for a fixed-location fire fighting nozzle to self regulate in order to discharge at an approximately constant, or targeted, pressure, because the discharge pressure governs what is referred to as the "authority" of the discharge stream and to a significant extent the stream's range. A "constant discharge pressure" nozzle comes closer to delivering a consistent stream at a fixed range than does a "fixed flow" designed nozzle. A fixed range is more desirable for a fixed-location nozzle with a fixed target.

One particular application in which a self-metering pressure regulating nozzle is useful is in a system of permanently stationed nozzles around locales subject to the leakage of toxic chemicals. Upon leakage, a permanently stationed configuration of relatively constant pressure nozzles (understanding that pressure regulation in a nozzle is only approximately achievable), possibly under remote control, can be activated to provide a predesigned curtain of water/fog to contain and suppress any toxic vapors. In such circumstances it may be optimal for nozzles to discharge their fluid with a constant range and authority as opposed to having their discharge structured and regulated for a relatively constant flow rate, as is more typical for "fixed flow" design fire fighting nozzles. Water/fog created with approximately constant range and authority, while operating under conditions of varying supply pressure, can more reliably curtain a preselected region from a fixed locale.

Typically, mobile fire fighting nozzles are designed as "fixed flow", structured to deliver an (approximately) pre-set level of gallons-per-minute flow, assuming a nominal supply of head pressure, such as 100 psi at the nozzle. When the head pressure actually available to a "fixed flow" nozzle in an emergency varies, flow rate tends to remain more constant in such designs than range. (Again, structuring a nozzle to target and regulate "discharge pressure" tends to let flow rate vary with variations in delivered pressure while keeping range more constant.)

A "hybrid" nozzle is a combination of "pressure-regulating" and "fixed flow" nozzle design features. It is designed to discharge fire extinguishing fluid at a pre-selected discharge pressure (and thus range) up to a targeted flow rate; thereafter it is designed to maintain a relatively constant flow rate while discharge pressure (and the range) are allowed to increase with supply pressure. A preselected discharge pressure, for example, would likely be 100 psi, but the preselected pressure could vary, and might more optimally be selected to be 120 psi. A targeted flow rate would be preselected and approximate. This "hybrid" design combines the benefits of maintaining range at low supply pressures (on low supply flow rates) while maintaining flow rate at nominal or higher supply pressures (on flow rates), thereby accommodating minimum range requirements, on the one hand, while, on the other hand, more easily accommodating self-educting features and/or a capacity to throw chemicals such as dry powder for nominal or higher supply pressures and flow rates.

The invention herein is compatible with both automatic or semi-automatic (hybrid) nozzles. It is compatible with self-educting foam nozzles, including enhanced eductive techniques, for both peripheral and central channeling, which enhanced eduction can be particularly helpful in automatic nozzles or when throwing chemicals such as dry powder, as well as non-self-educting foam nozzles.

Nozzle Basics

A fire fighting nozzle may be designed to be preadjustable to operate at a preselected fixed flow over a range of fixed flows compatible with the nozzle in design, such as from 500 gallons-per-minute to 2000 gallons-per-minute, given a certain nominal discharge pressure and flow supply (typically assumed to be around 100 psi). The preadjustment may be effected, for instance, by hand screwing a baffle in or out. By contrast, in an automatic nozzle that self regulates for pressure while allowing flow to vary, nozzle design typically incorporates an automatically self-adjusting baffle or the like, proximate the nozzle discharge. When fluid pressure at the baffle, sensed directly or indirectly, is deemed to lie below the targeted pressure, the baffle is structured in combination with the nozzle body to "squeeze down" on the effective size of the discharge orifice or gap. (The targeted pressure, in turn, can be adjusted by adjusting a pilot valve or other sensing mechanism, for example.) When pressure builds up at the baffle, sensed directly or indirectly, to exceed the preselected target pressure, the baffle is structured to shift to enlarge the effective size of the nozzle discharge orifice or gap. Enlargement continues, in general, until the discharge pressure reduces to the preselected target value. Adjustments in the size of the discharge orifice or gap, in accordance with this technique, allows flow rate through the nozzle to vary significantly while the discharge tends to have a constant discharge pressure, and thus a constant "authority" and range.

A hybrid design includes a further adaptation in self-adjusting nozzles. To continue to review the basics of a nozzle, a fire fighting nozzle defines a conduit for a fire fighting fluid that terminates in a discharge orifice. (The fire fighting fluid is usually water, and while it may be treated and discussed as water herein, it should be understood that nozzle technology is applicable to various fire fighting fluids.) The conduit and discharge orifice structure are typically designed in combination to recover, to the extent practical, fire fighting fluid pressure available from the fluid source. Recovery of pressure affects range.

Given generally anticipatable supply ranges for the fire fighting fluid, in pressure and in flow (industry standard sources of pressurized water might be anticipated to vary between 75 psi and 150 psi), nozzle body conduits and discharge orifices are designed to cover effective, or practical, flow windows. For instance, a "two and one-half inch" nozzle might be adjustable to effectively flow between 150 GPM and 600 GPM while a "sixteen inch" nozzle might be adjustable to effectively flow between 4,000 GPM and 16,000 GPM, both being affected by variations in supply pressure and quantity of fire fighting fluid.

Adjustable discharge orifices, either of the automatic (pressure-regulating) or manual (fixed flow) varieties, are designed to be adjusted within the range of flow effectiveness available for the nozzle body dimensions. Fluid flow rate through a given nozzle may be allowed to vary within the nozzle's effective flow window, also taking into account variations in fluid supply and pressure. Minimum limits on an effective flow window for a nozzle include a minimum effective "gap" size, or a minimum effective width of a typically annular discharge orifice for the nozzle. Below a certain "gap" size the thickness of the wall of water discharged diminishes to an extent that the water wall tends to disintegrate and nozzle throw performance suffers. On the other end, a "gap" can get so large that the fixed conduit bore structure of the nozzle itself governs throw. Thus, there are practical limits to the flow of water that can be efficiently and effectively flowed through a given nozzle bore size.

(It should be understood that although adjustable discharge orifices for fire fighting foam nozzles are traditionally designed in terms of an adjustable baffle within a fixed conduit, any element of nozzle structure defining at least in part the discharge orifice, including an outer wall portion, in theory, could be an adjustable element. One refers to traditional designs for convenience, in regard to an adjustable baffle located in a conduit where the adjustment of the baffle forward and backward governs gap size.)

Again, for a given nozzle size, there is a range in which baffle adjustment is effective and efficient. The range correlates with an effective or practical fluid flow window for the nozzle.

A given conduit and discharge orifice contribute to define a "k" factor for a nozzle. Flow rate and discharge pressure are related by the formula: $r=k\sqrt{p}$, where r is the flow rate, p the discharge pressure and k the "k" factor. It can be seen that for a constant k, flow varies with the square root of pressure. With a fixed conduit and discharge orifice, discharge pressure p rises with increased supply pressure from the fluid source while flow rate "tends" to remain relatively constant, at least as compared to pressure, because it only increases with the square root of pressure.

Automatic Nozzles

"Automatic" nozzles have automatically adjustable discharge orifices. Automatically adjustable discharge orifices, as discussed above, are typically designed to maintain a preselected targeted discharge pressure, such as 100 psi. In automatic nozzles there is typically a means for sensing discharge fluid pressure and a biasing means structured to adjust the discharge orifice (sometimes referred to as the "gap") until the sensed discharge pressure is approximately a preselected targeted discharge pressure. (The word "approximately" is used herein and throughout because automatic nozzle designs are only "approximately" accurate.) As a result of sensing and adjustment, a discharge orifice or gap is narrowed or widened in an automatic nozzle so that the sensed discharge pressure is approximately the selected discharge pressure. Again, as discussed above, when the discharge orifice or gap is narrowed, fluid flow rate through the nozzle is reduced. As the gap is widened, fluid flow rate through the nozzle is increased. If the discharge orifice of the nozzle were to remain fixed, the "k" of the nozzle would remain fixed and flow rate would "tend" to remain fixed while discharge pressure would vary with supply pressure. (Flow rate varies only with the square root of pressure.).

Foam Nozzles

Advantage of constant flow rate. As foam concentrate or additive is designed to be metered into a fluid stream at a constant percent (e.g. 3% or 6% or the like), a relatively constant flow rate of the fluid stream is an advantage as it allows relatively simple metering devices for the foam concentrate to be set. A constant flow rate with a high discharge pressure is also an advantage, as high pressure helps some concentrates create better foam. In a nozzle that discharges a chemical, such as a dry powder within a fire fighting fluid, constant flow rate may be an advantage in order to limit fluid flow rate so as to avoid unnecessary wetting of the powder. Furthermore, nozzles that adjust essentially without limitation to target a selected discharge pressure, thereby allowing flow rate to rise without limit, can waste water when there is a limited supply of water.

Advantage of constant pressure. Although a relatively constant flow rate from a nozzle can be an advantage in many situations, if the supply pressure is weak or if a nozzle is set at a fixed distance from a fire, a relatively constant pressure can be an advantage. Constant pressure tends to maintain range for a nozzle, even though flow rate may diminish.

Within the time span of one fire, the relative importance of constant pressure and of constant flow rate can shift.

A "hybrid", or "selectively automatic" nozzle, combines the two worlds, constant flowrate and constant pressure. An adjustable stop (or any other such adjustable means) can be set so that an automatically adjustable discharge orifice is provided, as in an automatic nozzle, for flow rates up to a given point, a preselected target (in a nozzle's effective flow window). When supply pressure goes low, range is maintained. However, if and/or when targeted fluid flow rate within the nozzle is reached, the stop or the like causes the discharge orifice to cease adjusting. Discharge pressure rises with supply pressure but fluid flow rate tends to remain constant (again, rising only in proportion to the square root of the pressure). Metering in a foam concentrate in a preselected proportion or ratio is more reliable.

SUMMARY OF THE INVENTION

By speaking of flow gap elements that relatively adjust, it is to be understood that one only needs to be adjusted with respect to the other, which is usually the case. However, of course, multiple elements could adjust in an unusual design. When flow gap defining elements relatively adjust in response to fluid pressure, the flow of the nozzle will tend to directly adjust or vary. With such a fire fighting nozzle, typically referred to as an automatic nozzle, the gpm flow varies while discharge pressure in this nozzle remains relatively constant. A "hybrid" nozzle is part automatic and part fixed flow, automatic for a portion of a flow range, typically a low portion, and "constant flow" (variable pressure) for a second portion of the flow range, typically a nominal to high portion.

The instant invention comprises a self-metering automatic industrial scale fire fighting nozzle. An additive passageway is in fluid communication with a fire fighting liquid conduit of the nozzle. The conduit has a discharge orifice that varies in size with supply pressure of the liquid, at least for part of a flow range of the nozzle. Preferably structural elements or a valve provide means for occluding automatically the opening size of the additive passageway in response to variations in size of the discharge orifice.

The invention preferably includes a ratio selector for automatically self-metering a selected ratio of additive in response to variations in the discharge orifice size.

Preferably also the invention includes a mechanical flowmeter, a mechanical device to permit the fire fighter to determine the gpm flow rate of such nozzles. As flow gap defining elements relatively adjust, a structure of the nozzle adjusts a mechanical indicia of flow, having an externally visible and calibrated indication, in response thereto. While hydraulically sensitive flow indicators have been taught for industrial scale fire fighting nozzles, the advantage of the instant mechanical flow indicator is that it should not be affected by turbulence of the fluid in the nozzle or nozzle conduit.

The invention also includes methods for automatically metering a preselected ratio of additive into an automatic industrial scale fire fighting nozzle. The method includes adjusting occluding elements or occluding or valving a passageway in tandem with a varying fire fighting liquid conduit discharge orifice sizes. The method preferably includes selecting between a plurality of additive ratios for the automatic metering and mechanically linking a flow rate indicia with a mechanical flow rate means.

BRIEF DESCRIPTION OF THE DRAWINGS

A better understanding of the present invention can be obtained when the following detailed description of preferred embodiments are considered in conjunction with the following drawings, in which:

FIGS. 3A-R and 3D-R are reproduced from the application incorporated by reference herein, for quick reference.

FIGS. 7A and 7B meter for low flow and high flow at a low selected ratio; FIGS. 7C and 7D meter for low flow and high flow at a higher selected ratio, 3%; and FIGS. 8 and 9 illustrate the interrelated parts individually.

Figure 1B:
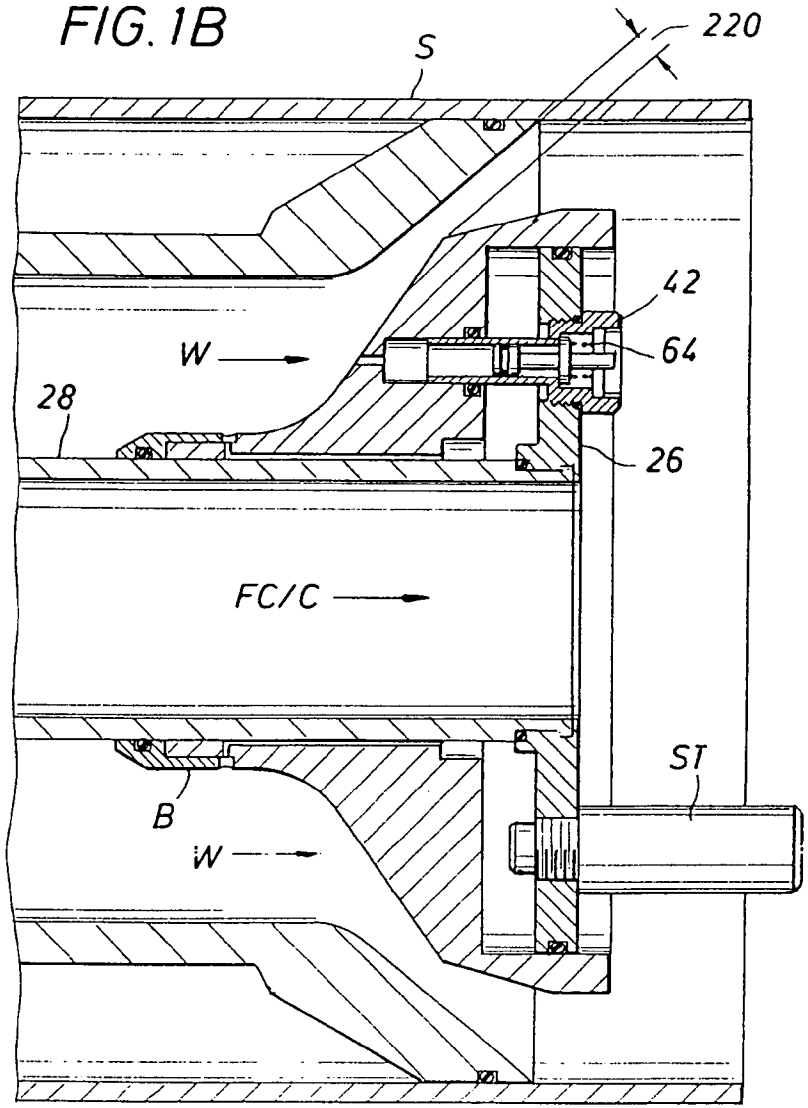
FIGS. 1A, 1B, and 1C illustrate in cutaway an embodiment for a selectively automatic fire fighting nozzle (hybrid).

The drawings are primarily illustrative. It should be understood that structure may have been simplified and details omitted in order to convey certain aspects of the invention. Scale may be sacrificed to clarity.

DETAILED DESCRIPTION OF THE PREFERRED EMBODIMENTS

Generally, a nozzle having an "adjustable" baffle, adjustable in order to discharge fire extinguishing fluid at a selected pressure, uses a biasing means opposing a natural tendency of the baffle to move outwards in response to fluid pressure. The outward movement tends to open the effective size of a discharge orifice. The biasing means biases with a backward force equal to the force of the desired or selected fluid pressure upon the forward baffle surfaces. Hence baffle forward pressure on the baffle balances against backward bias pressure on the baffle at the selected or targeted pressure. Forward baffle pressure surfaces are surfaces that the baffle presents to the fire extinguishing fluid moving through and out of the discharge port.

In theory, the biasing force could be provided by a spring that, over the adjustment range of the baffle between its end points, which may be no more than approximately one half of an inch, presents an essentially constant biasing force at the selected pressure. The selected pressure might be 100 psi. Alternately, an adjustable bafflehead can be designed defining a chamber within the bafflehead and presenting forward and backward surfaces against which the primary fire extinguishing fluid can act. The chamber defined within the bafflehead would have means for permitting the fire extinguishing fluid to enter the chamber from the conduit. In such design the effective backward pressure surface area usually exceeds the effective forward pressure surface area. The fluid pressure within the baffle chamber is slightly less than the pressure exerted on forward facing baffle surfaces. By such design the fluid within the baffle acts against a greater surface area and, although lower in value, can potentially drive the baffle backwards against the flow of fluid through the nozzle. Anticipating the differences between the pressures, without and within the baffle, at different source pressures, and anticipating the differences in the effective areas presented to the fluid pressures at different head pressures and flow rates, leads to a design for a "balanced baffle" at a targeted fluid pressure. Spring mechanisms can be added to augment the biasing forces provided by the primary fire extinguishing fluid pressure upon the bafflehead forward and backward surfaces. (If or when baffle adjustment results in a variation of the volume of the defined baffle chamber, as by the baffle sliding over a fixed piston, relief should be provided to vent fluid from inside the chamber.)

Reference is made to the patent applications incorporated herein by reference for more discussion and illustrations. This application discloses in particular the use of at least one relief valve in order to heighten the accuracy and speed of balance and to lessen undue hunting or hysteresis. A relief valve vents fluid pressure from one or the other side of the baffle, preferably from within the baffle chamber, when fluid pressure varies from target pressure. Such venting typically causes the baffle to move, as in an illustrated case, outward toward one of the baffle location end points. A movement outward or toward the outward end direction will cause a decrease in the forward fluid pressure upon the baffle. Such decrease in forward fluid pressure will cause the relief valve to again close, permitting the buildup of fluid pressure upon the back side of the baffle. The build up of fluid pressure upon the back side of the baffle will help adjust the baffle toward a balanced position where the fluid pressure on the forward surfaces of the baffle balances the fluid pressure on backward surfaces of the baffle, taking into account their respective pressure areas and other biasing elements such as a continuously "bleeding" relief valve and/or any springs utilized in the design.

In operation, the self-adjusting automatic feature of the nozzles of the figures depends upon an adjustable baffle that adjusts in response to primary fire fighting fluid pressure, presented both to a forward side and a reverse side of a baffle surface. In such a manner the baffle operates as a two-way piston seeking a balanced pressure position. The primary nozzle liquid provides a fluid pressure to act against both sides of the baffle. The pressure acting in the reverse direction will be at least a function of the forward pressure. Preferably the reverse pressure surface of the baffle will be larger than the forward pressure surface of the baffle. It is recognized that the forward pressure surface of the baffle may in fact change and be a function of pressure and fluid flow through the nozzle, as well as baffle design and nozzle size. Although it would be possible to design a baffle having a balanced position where the targeted forward pressure times the forward pressure surface equals the reverse pressure times the reverse pressure surface, such a balancing technique is difficult to effect in practice. Hence, preferred embodiments utilize at least one relief valve. Preferred embodiments further utilize a relief valve to relieve pressure in the reverse direction. In preferred embodiments the area of the reverse pressure surface is greater than the area of the forward pressure surface. Thus, in preferred embodiments, when the relief valve is closed, in general, the reverse pressure times the area of the reverse pressure surface will be greater than the forward pressure times the area of the forward baffle surface. This will dictate that for significant values of forward pressure the nozzle is biased closed. As the baffle closes, the pressure forward at the bafflehead will tend toward its maximum deliverable pressure in the nozzle. At some point near the forward target pressure, one or more relief valves begin to open relieving pressure on the reverse side of the baffle and allowing the bafflehead to adjust outward and balance open. Preferably the relief valve builds in a degree of adjustability such that the relief valve can select a partially opened position and settle upon such position without undue hunting and wherein the target pressure times the forward surface at the target pressure equals the reverse pressure times the reverse pressure surface area taking into account the degree of openness of the relief valve system.

Figure 1A:
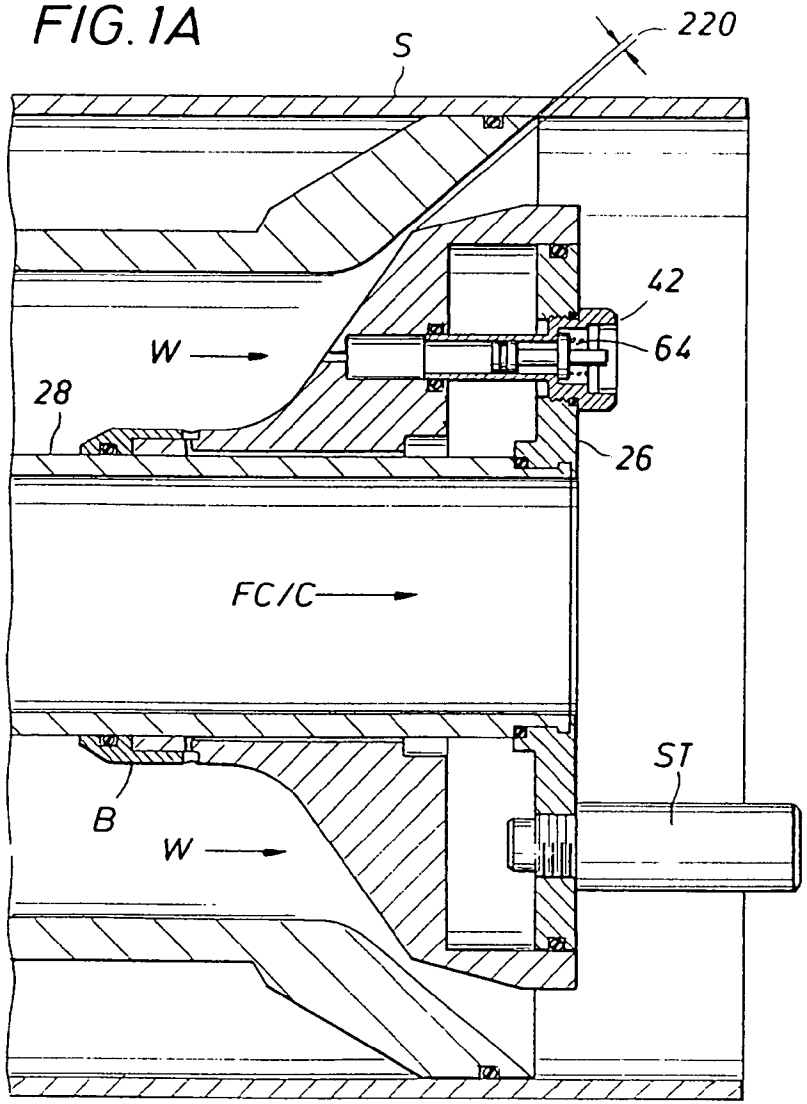
Figure 1C:
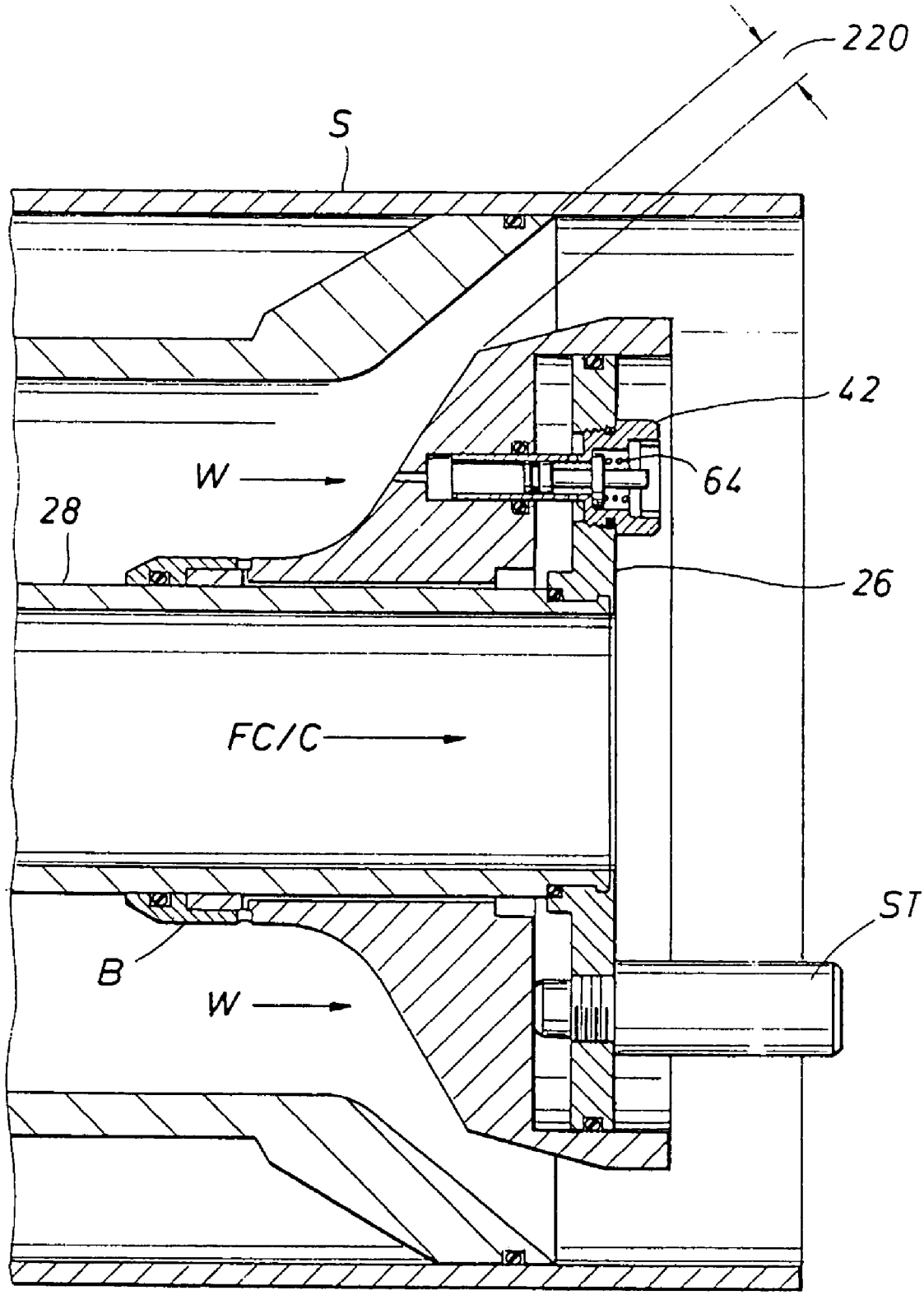
Figure 2A:
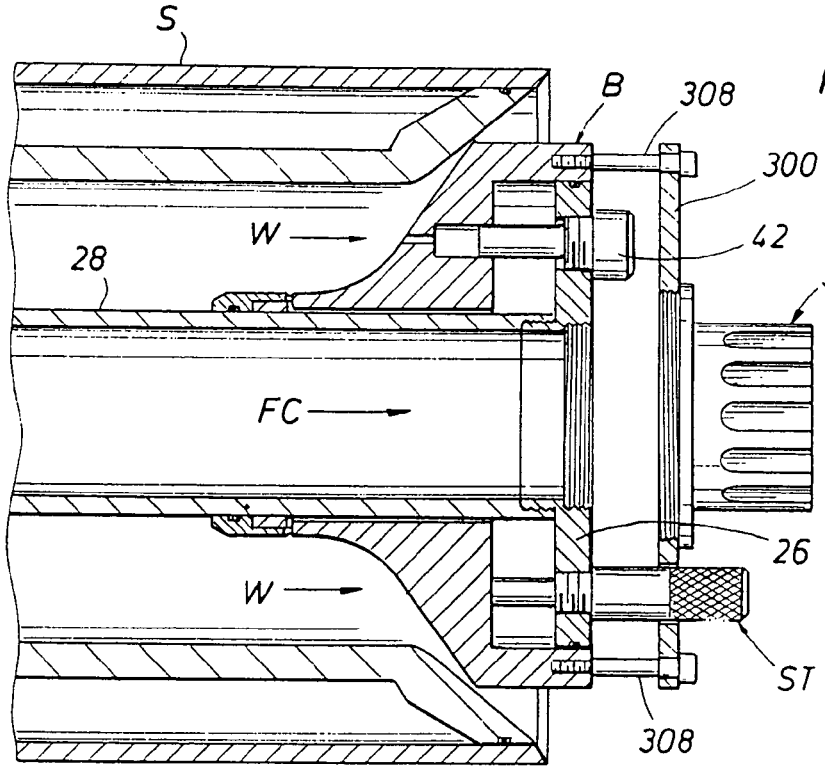
FIG. 2A illustrates an embodiment of a selectively automatic fire fighting nozzle with a flood plate.
Figures 1, 2B:
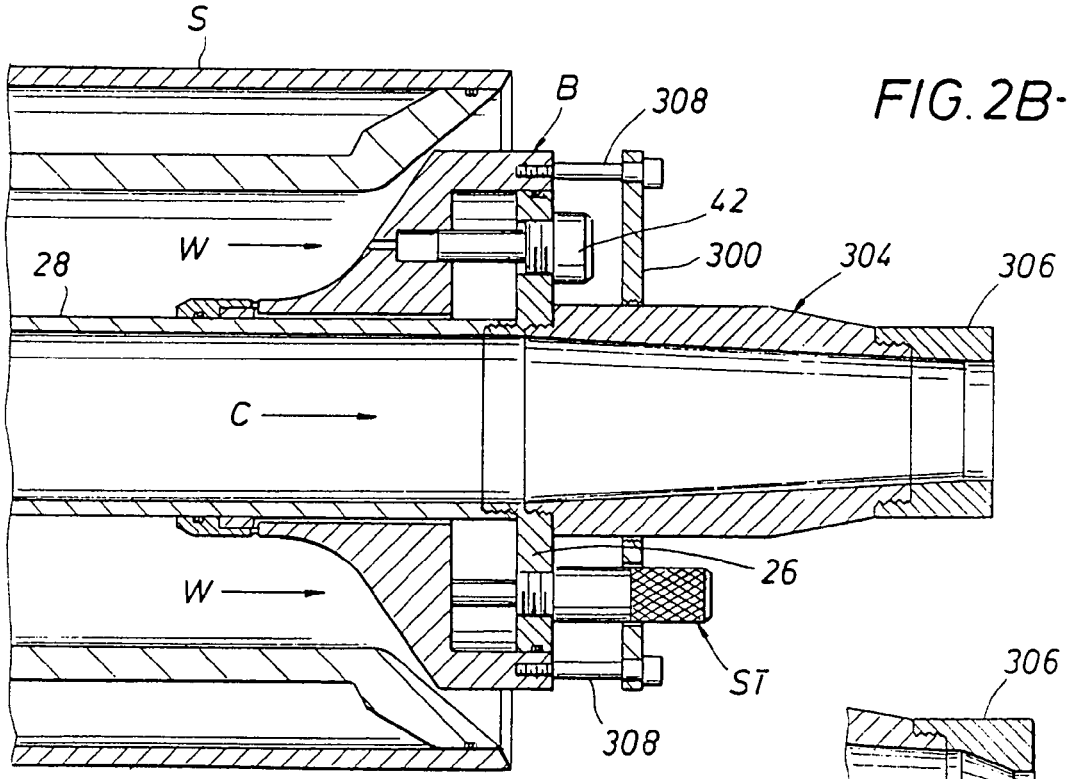
FIG. 2B illustrate an embodiment of a selectively automatic fire fighting nozzle suitable for chemical application.
Figures 2, 2B:
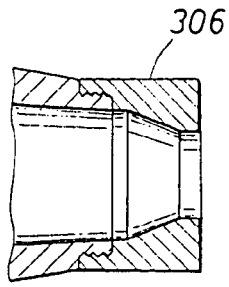
Figures 1, 3A:
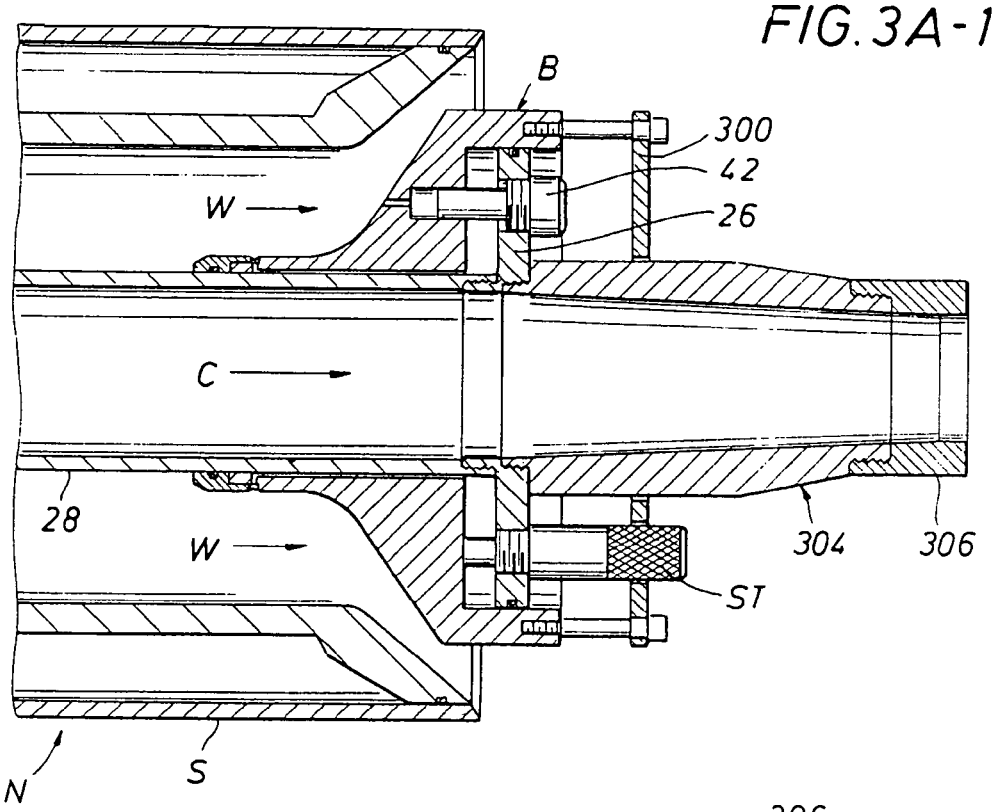
FIGS. 3A and 3B illustrate a set of stops structured to target different flow rate, for selecting automatic nozzles above.
Figures 2, 3A:
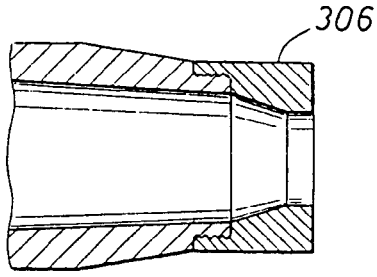

FIGS. 1A, 1B, 1C, 2A, 2B, 3A and 3B illustrate embodiments of a semi-automatic fire fighting nozzle (hybrid). FIGS. 3A-R and 3D-R illustrate a self-metering automatic nozzle.

More particularly, FIGS. 1A, 1B and 1C illustrate a pilot valve 42 situated in piston 26. Floating bafflehead B moves outward over the piston 26, as controlled by pilot valve 42, to the right to widen gap 220. FIG. 1A illustrates a gap 220 suitable to flow 1,000 GPM while FIG. 1B illustrates a gap 220 suitable to flow 2,000 GPM and FIG. 1C illustrates a gap 220 suitable to flow 4,000 GPM. Water W flows through the nozzle body in FIG. 1 from left to right. Foam concentrate FC or chemical C flows through the foam/chemical tube 28. FIGS. 1A, 1B and 1C illustrate flow stop ST. The flow stop is shown set for a "4,000 GPM" gap 220 size, illustrated in FIG. 1C. In the preferred embodiment shown, flow stop ST is conveniently affixed to a portion of piston 26. When an inside surface of floating bafflehead B reaches or contacts flow stop SD, floating bafflehead B ceases to further adjust outward or to the right over the piston. If water supply and pressure increases, the gap will remain as in FIG. 1C. Flow rate will remain approximately 4,000 GPM while discharge pressure will rise. Pilot valve 42 is presumed to be set at some pre-selected pressure such as 100 psi. As in previous nozzles, when the water supply and pressure from the source produce a pressure at the bafflehead greater than the pre-selected pressure, pilot valve 42 leaks fluid from the baffle chamber and floating bafflehead B moves out, or downstream, widening the gap created between the floating bafflehead B and the nozzle body, unless or until stopped by a setting of flow stop ST. In all three drawings pattern control sleeve S is included, as is customary for a fog nozzle. For clarity the sleeve is shown in a more or less "fog" pattern position.

FIGS. 2A and 2B illustrate embodiments similar to FIGS. 1A-1C, but with a flood plate so attached. FIGS. 2A, 2B, 3A and 3B show a flood plate 300 attached by pins 308 to floating bafflehead B. The flood plate can be adjusted for a foam application, as in FIGS. 2A and 3B. In this instance plug 302 is attached to flood plate 300. Alternately, the nozzle can be adjusted for a hydrochemical application, as in FIGS. 2B and 3A, in which case chemical extension tube 304 is affixed to flood plate 300. Adjustable chemical flow chokes 306 are usually provided with a chemical extension tube 304. The nozzle embodiment of FIGS. 2B and 3A is thus adapted to throw not only water but or a water foam combination but also dry chemical. The nozzle embodiment of FIG. 2A is adapted to throw water mixed with foam concentrate at the discharge. In FIGS. 2A and 2B a flow stop ST, illustrated more particularly in FIGS. 3A and 3B, is shown achieving a full closed position for the nozzle. Alternate flow stops ST can installed, by the design of one preferred embodiment, to permit bafflehead B to move out into the positions illustrated in FIGS. 1A, 1B, 1C, 3A and 3B.

Figures 3, 3A:
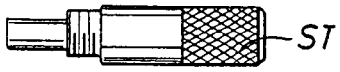

In a preferred embodiment illustrated in FIG. 3 a set of stops ST are provided, each stop with a different shank length to govern a different gap size. Alternately, however, one stop could be provided adjustable as by screwing. Other equivalent means could be utilized to place a limit on a floating bafflehead or the like in its forward or downstream movement.

The nozzle show in FIGS. 2A and 3B are adaptable to be used with a self-metering and self-educting nozzle.

In operation, the hybrid (partially automatic) nozzle would be presumed to be set to target a preselected discharge pressure such as 100 psi. The operator, as in the preferred embodiment of FIGS. 3A and 3B, would also select a stop that approximately targets a given flow rate. The operator will affix the stop in the position provided in the fixed piston. The floating bafflehead will then maintain a targeted pressure until the bafflehead is stopped by abutting the end of the flow stop that extends through the piston into the baffle chamber. Thereafter, if supply pressure rises and supply flow is adequate, the discharge pressure at the nozzle will rise. The gap will remain constant and the flow rate will remain approximately constant.

In regard to the use of terms herein, "additive" usually at least includes a "foam concentrate". "Industrial-scale" can be said to indicate a nozzle with a flow rate of at least 50 gpm and preferably at least 100 gpm. "Self-educting" should be understood to indicate self-educting at least in part. "Automatic" should be understood to indicate automatic at least in part. An automatic nozzle self-regulates flow to maintain discharge pressure. When a valve is discussed, valve should be understood to generically include passageway portion(s), opening(s), orifice(s), and/or occlusion structure(s). A valve may be viewed as a combination of port or ports, passageway or passageways, and orifice or orifices, together with some occluding structure or occluding structures. Some or all of the foregoing adjust.

Automatic nozzles automatically adjust flow rate to maintain discharge pressure, at least in part. Self-metering automatic foam nozzles, with or without self-eduction, are disclosed herein. Self-educting nozzles use the primary fluid flowing to the primary nozzle conduit to educt an additive and insert it into the primary fluid at or prior to discharge. Since, in an automatic nozzle, flow rates can vary, an automatic foam nozzle, with or without self-eduction, has an advantage if it provides for self-metering of an additive not already premixed with the water or fire fighting fluid. In one preferred embodiment, such self-metering is accomplished by moving or adjusting an occluding structure over an orifice through which the additive enters into an eductive structure. Preferably the occluding structure is attached to and moves in tandem with an "automatic" structure that adjusts in accordance to sensed pressure of the fire fighting fluid. A ratio selectable, self-metering automatic nozzle provides for selecting different additive concentrations or ratios and then automatically metering for that concentration level, by means of the appropriate valving.

An automatic self-metering nozzle is disclosed in the patent application, U.S. Ser. No. 09/284,561, incorporated herein by reference, the automatic self-metering nozzle being illustrated in drawings 3A and 3D, reproduced herein as FIGS. 3A-R and 3D-R, for convenience.

Self-educting is not necessary for an automatic self-metering nozzle. As nozzle sizes grow large as, say above 2000 gpm, it becomes less effective to self-educt foam concentrate into the nozzle and more effective to separately pump or educt foam concentrate into the nozzle. Of course, a combination of a separate pump or eductor as well as some self-eduction, i.e. a combination of pumping means, could be effectively utilized.

Self-metering is a valuable aspect of an automatic nozzle, whether or not self-eduction is utilized, or notwithstanding the extent to which self-eduction is utilized. If self-eduction is not desired, given the design of the nozzle of the drawings FIGS. 3A-R and FIGS. 3D-R, then the opening 92 into which water stream W flows can be closed off by a suitable plug. Such mechanism is known in the art and has been utilized when it is desired to pump fluids other than foam concentrate, such as a chemical additive or a particulate powder, through conduit 28.

The "hybrid" feature, characterized by the preferred embodiment of FIGS. 1A through 3B-1, can be incorporated into any automatic nozzle. It is possible to implement such means in a self-metering nozzle, with or without self-eduction.

Figures 3, 3A, 4, 5, 6:
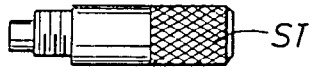
FIG. 5 illustrates a mechanical flow meter for an automatic nozzle.
Figures 3, 3A, 4:
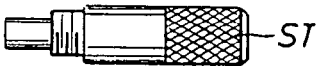
Figures 3, 3A, 4, 5, 6, 7:
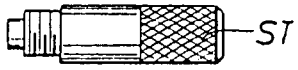
Figures 3, 3A, 4, 5:
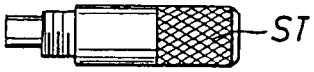

The embodiment of FIGS. 4 and 7 illustrate how a "concentrate selectable" or "ratio selectable" feature and indicator can be integrated into and with a self-metering automatic nozzle. The drawing of FIG. 5 illustrates how a mechanical flowmeter can be integrated into and with an automatic nozzle. More particularly, the drawing of FIG. 5 illustrates the integration of a mechanical flow meter with a self-metering automatic nozzle.

Figure 4A:
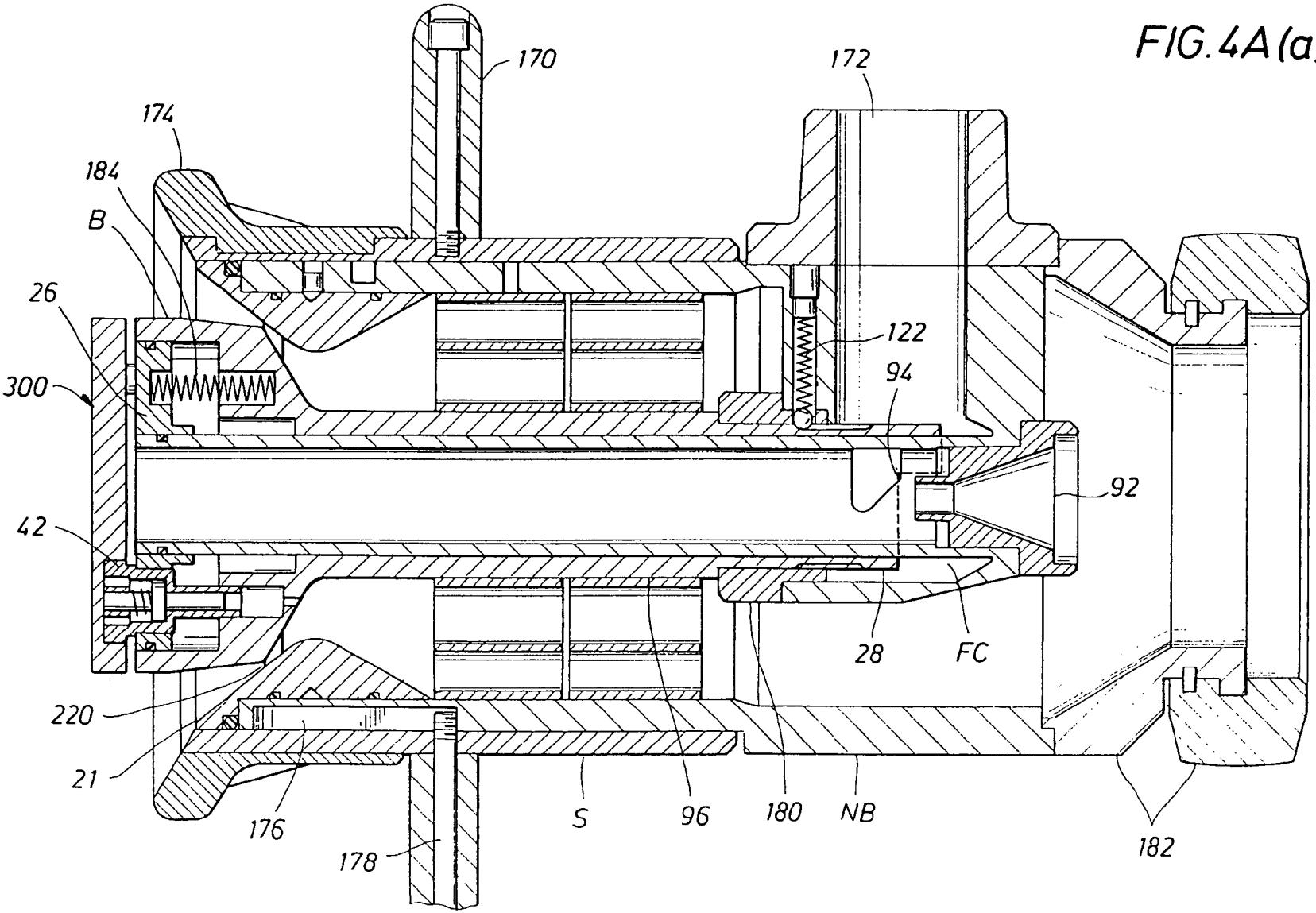
FIGS. 4A, 4B, 4C and 4D illustrate an automatic self-metering nozzle providing a selector for selecting from concentrate ratio.
Figure 4A:
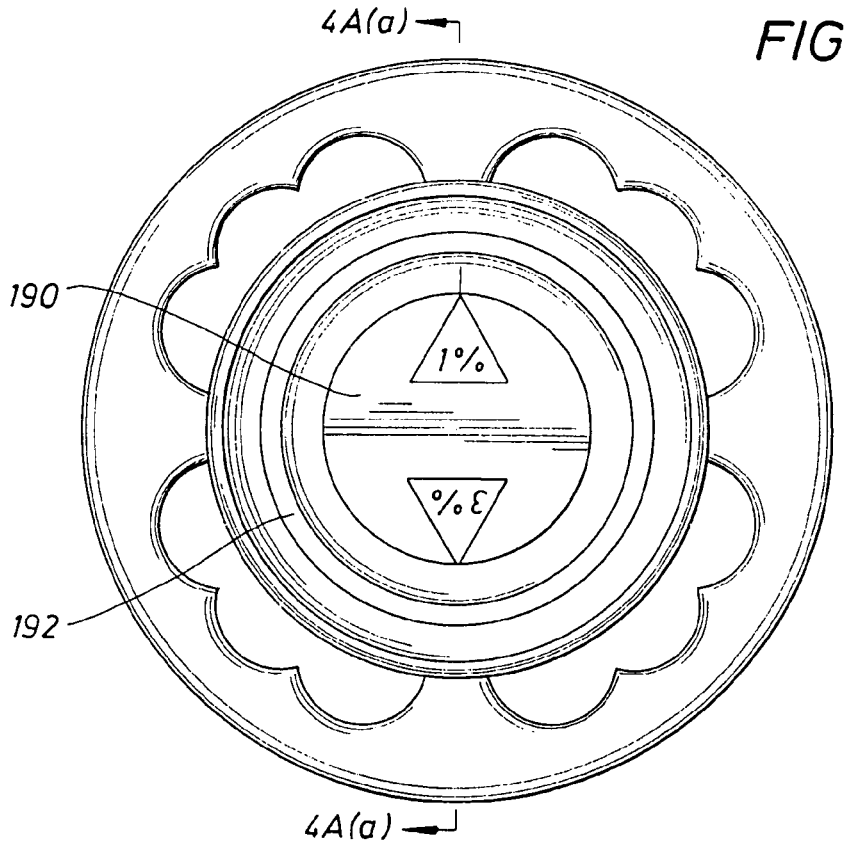

FIG. 4A illustrates a ratio selectable, self-metering automatic nozzle set for a 1% ratio of additive or foam concentrate to water and adjusted to low flow. Flow gap 220, as illustrated, is barely open, indicating low flow. Bafflehead B has adjusted, through flow control pilot 42, to squeeze back against bearing head 21 in order to minimize flow gap 220. By such arrangement, discharge pressure through flow gap 220 is maximized.

The "ratio selectable apparatus" illustrated in FIGS. 4A through 4D is capable is selecting between two ratios, 1% and 3%. In FIG. 4A, a 1% ratio has been selected. In the embodiments of FIG. 4, the selection is accomplished by the rotation of flood plate 300. In the embodiments of FIG. 4, flood plate 300 has two positions, a 1% and a 3% position. The two positions are governed by rotation of the flood plate 180 degrees. Corresponding to the two positions are two detents on flow metering tube 96 that, as connected to bafflehead B, rotate with flood plate 300. The two detents are located around foam metering tube 180 degrees separation and are designed to in general center themselves under detent ball and spring 122. Piston 26 and flow control pilot 42 rotate with flood plate 300 and bafflehead B. However, it should be remembered, piston 26 and flow control pilot 42 do not adjust inwardly and outwardly along the longitudinal axis of the nozzle with bafflehead B and flood plate 300.

Figure 7A:
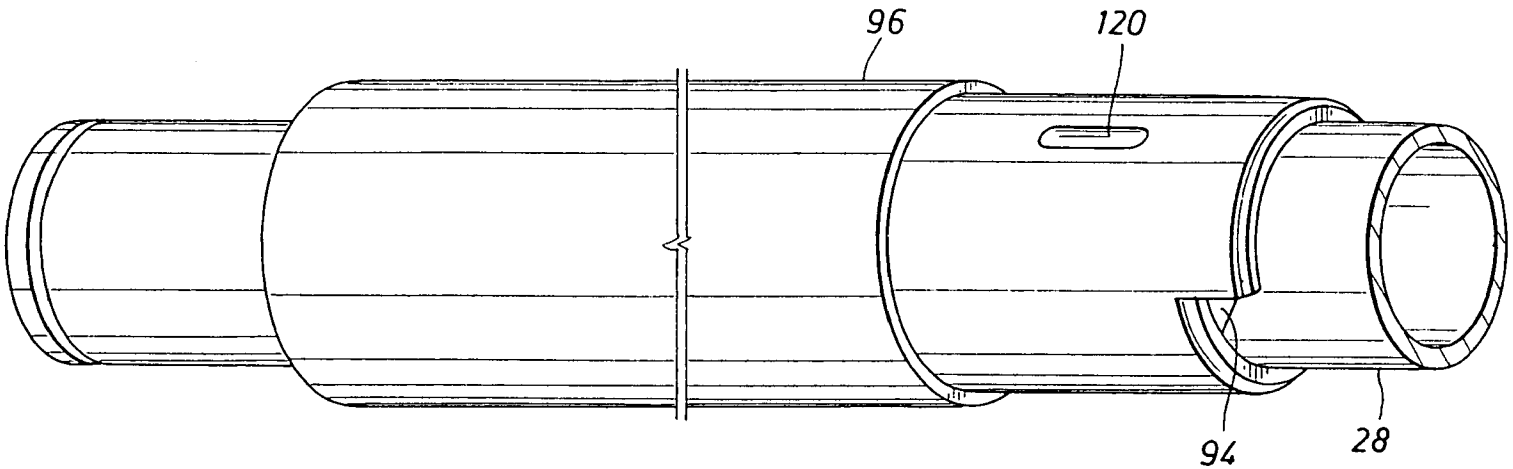
Figure 7B:
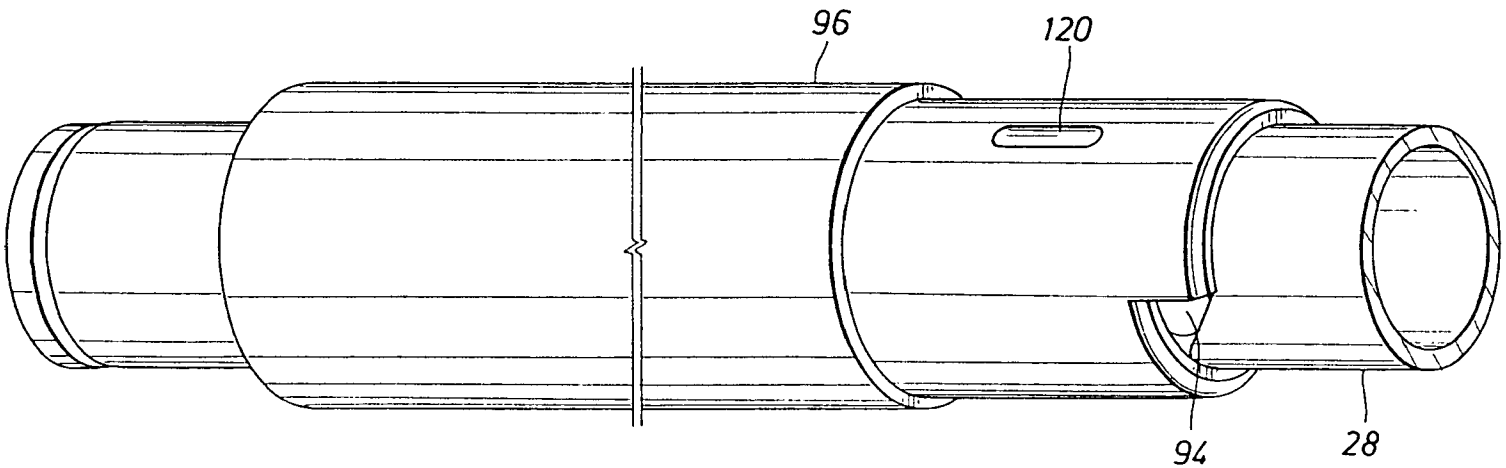

FIGS. 7A through 7D more particularly illustrate rotatable and longitudinally adjustable foam metering tube 96 in conjunction with stationary center support foam tube 28. Adjustable foam metering tube 96 together with fixed center support foam tube 28 together define metered foam orifice 94. As illustrated in FIG. 7A, detent 120 of foam metering tube 96 is shown in a first, upper position. In such upper position with foam metering tube 96 adjusted to the right in the drawing over foam tube 28, metering foam orifice 94 is minimized. Such minimal position is appropriate for a selected ratio of 1% and a low flow. FIG. 7B illustrates relative positioning of foam metering tube 96 and fixed foam tube 28 for a high flow 1% ratio position. It can be seen that detent 120 remains in the same position while foam metering tube 96 has shifted to the left over center support foam tube 28. Metered foam orifice 94 is shown enlarged for higher flow but still set for 1% proportioning.

Figure 4C:
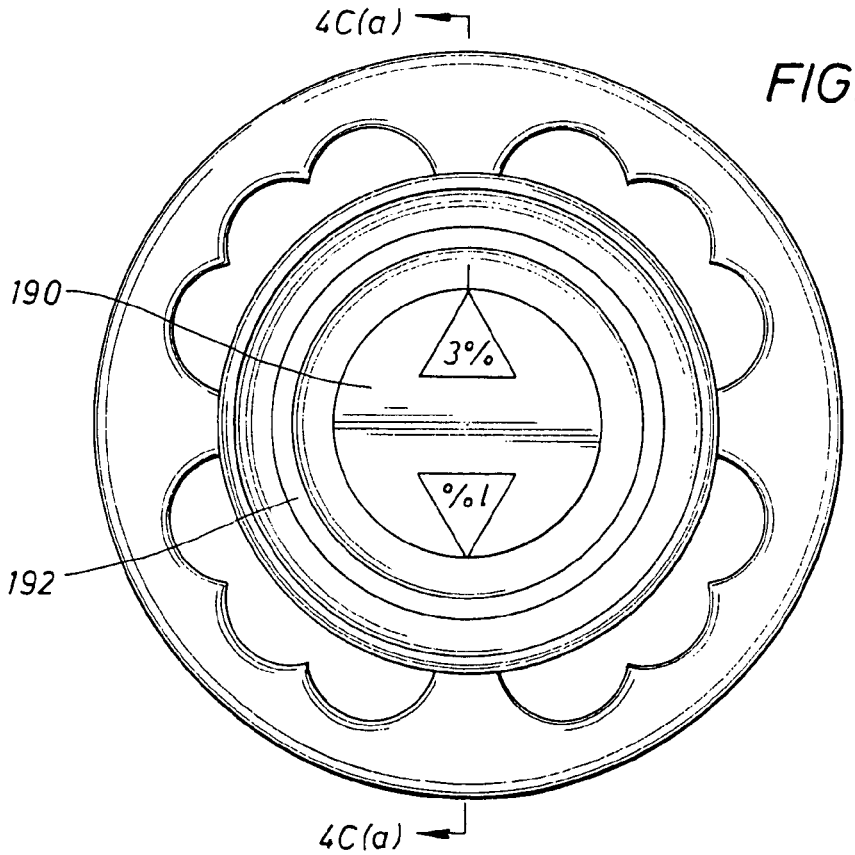
Figure 4B:
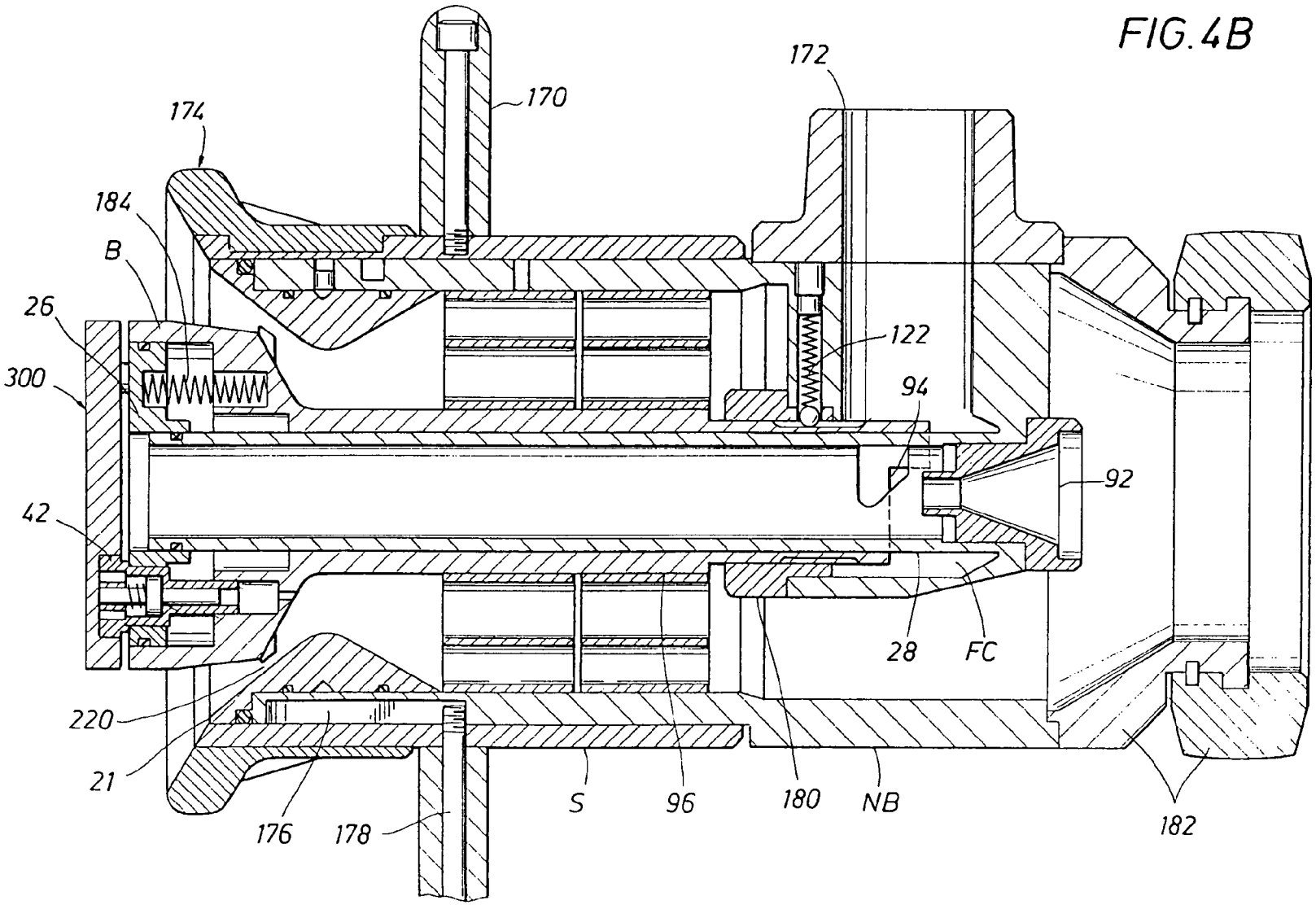
Figure 4C:
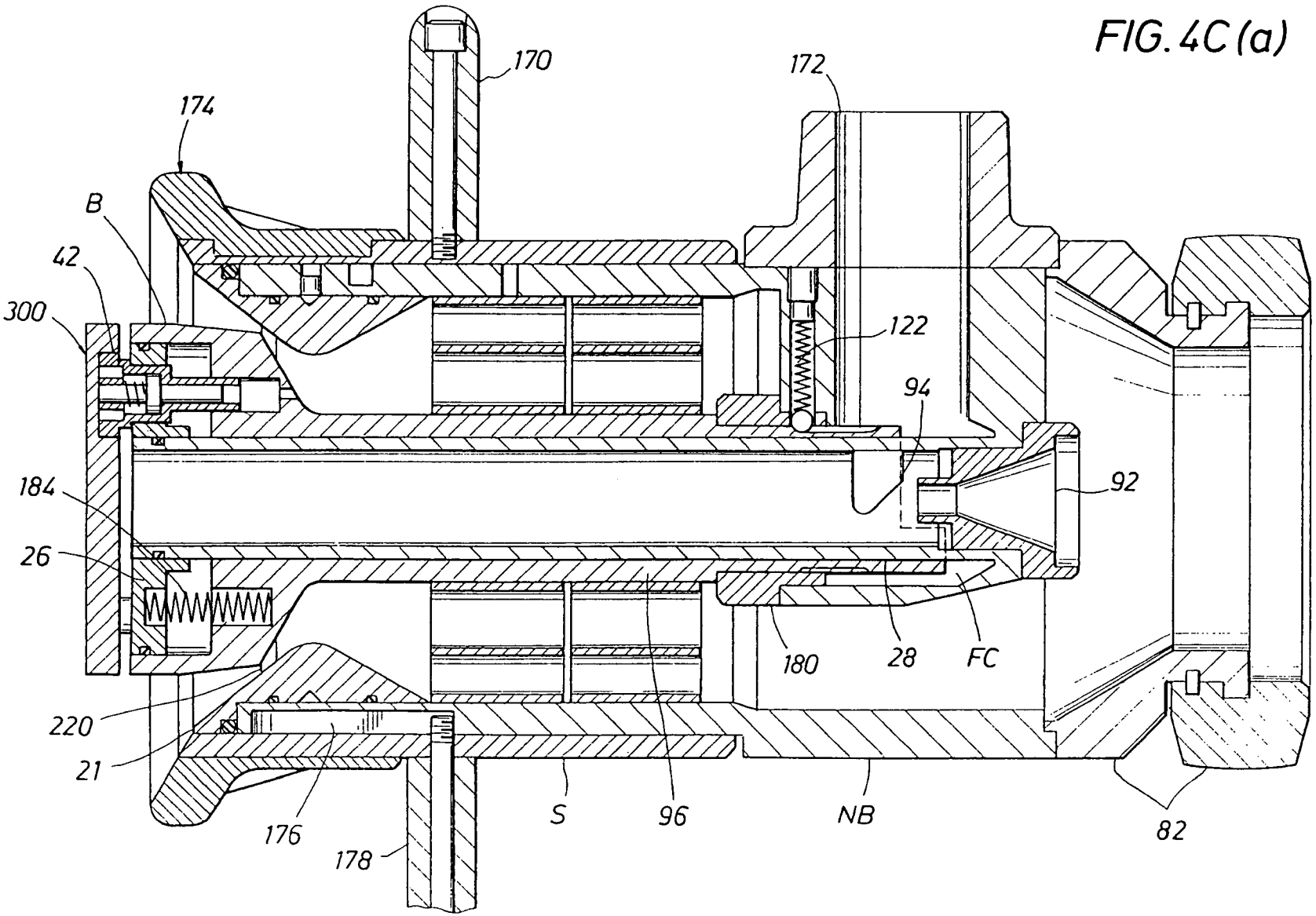

FIG. 4B illustrates the ratio selectable self-metering nozzle set for 1% ratio and high flow. It can be seen that the flood plate, bafflehead and foam metering tube have shifted to the left in order to increase the size of the metered foam orifice. Note again that in this embodiment the piston rotates with the flood plate and bafflehead but does not translate with the flow plate and bafflehead.

Figure 4D:
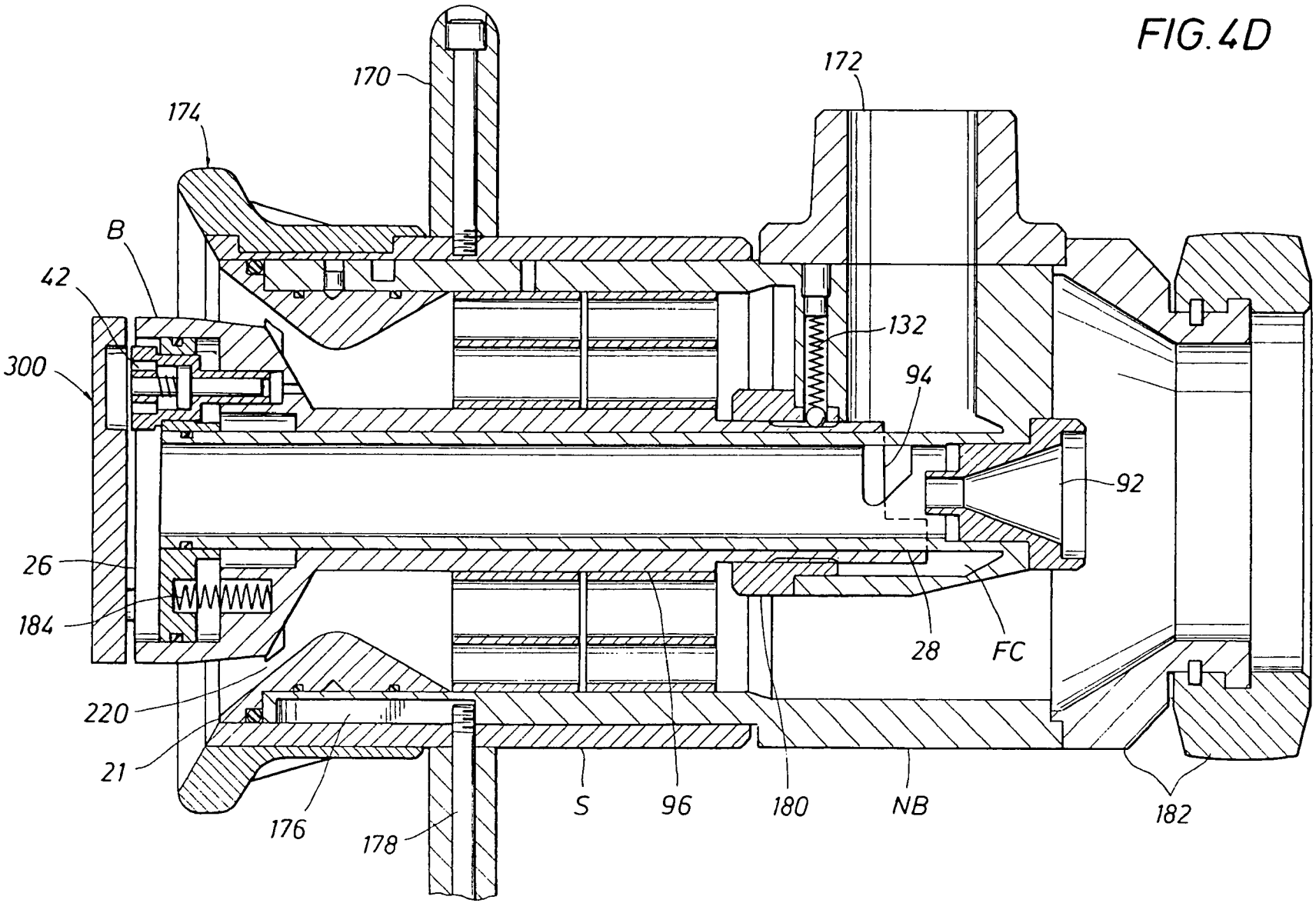
Figure 5:
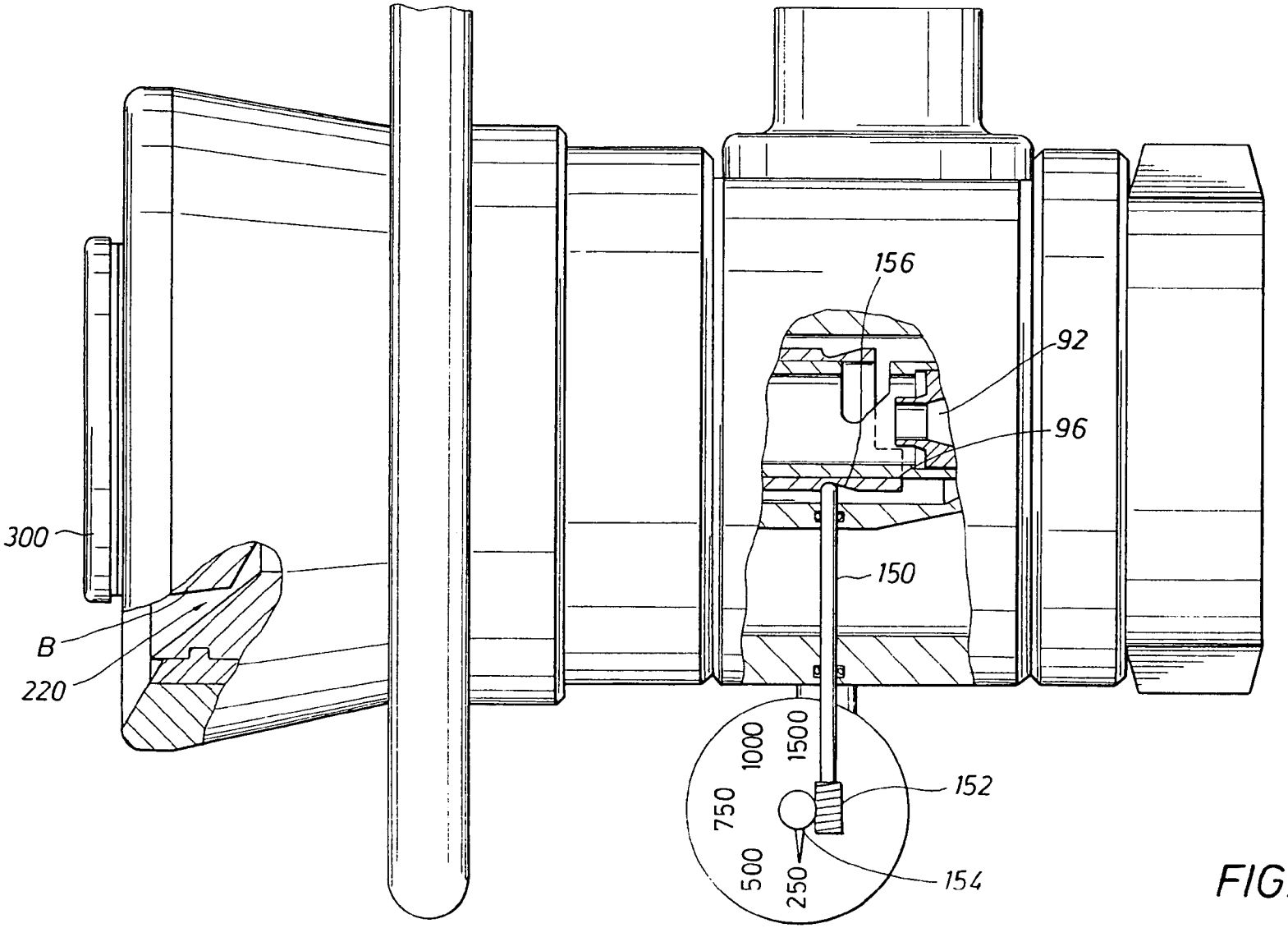
Figure 7C:
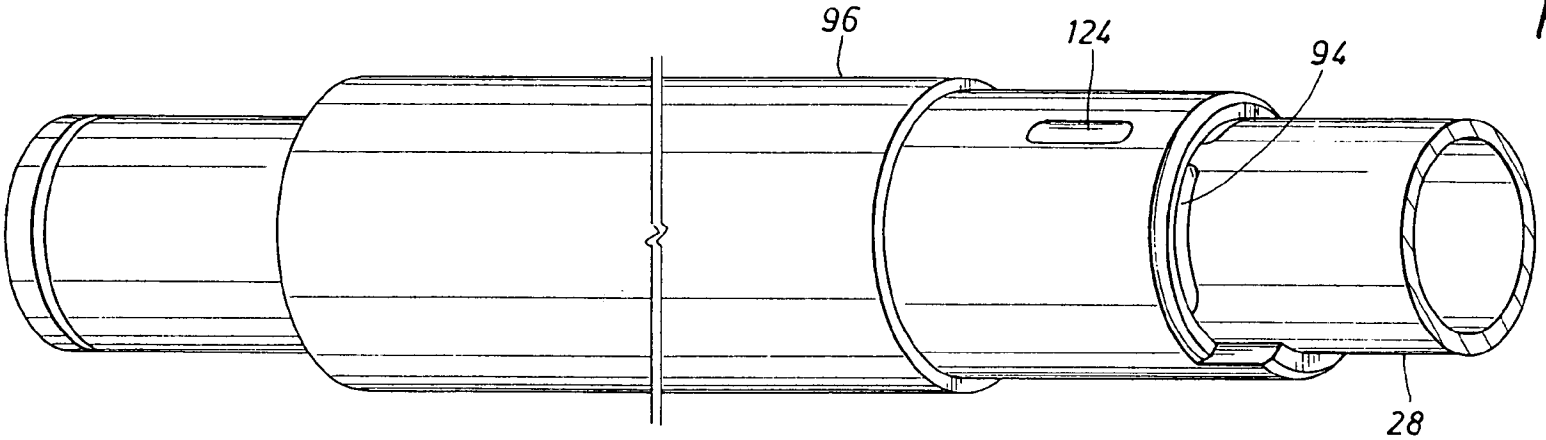
Figure 7D:
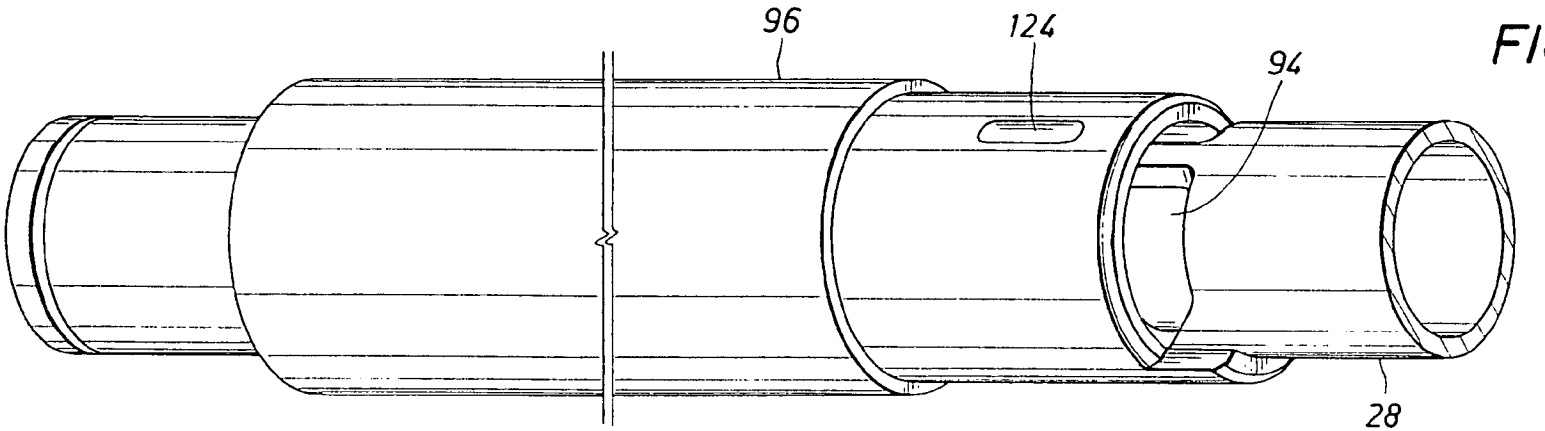
Figure 8:
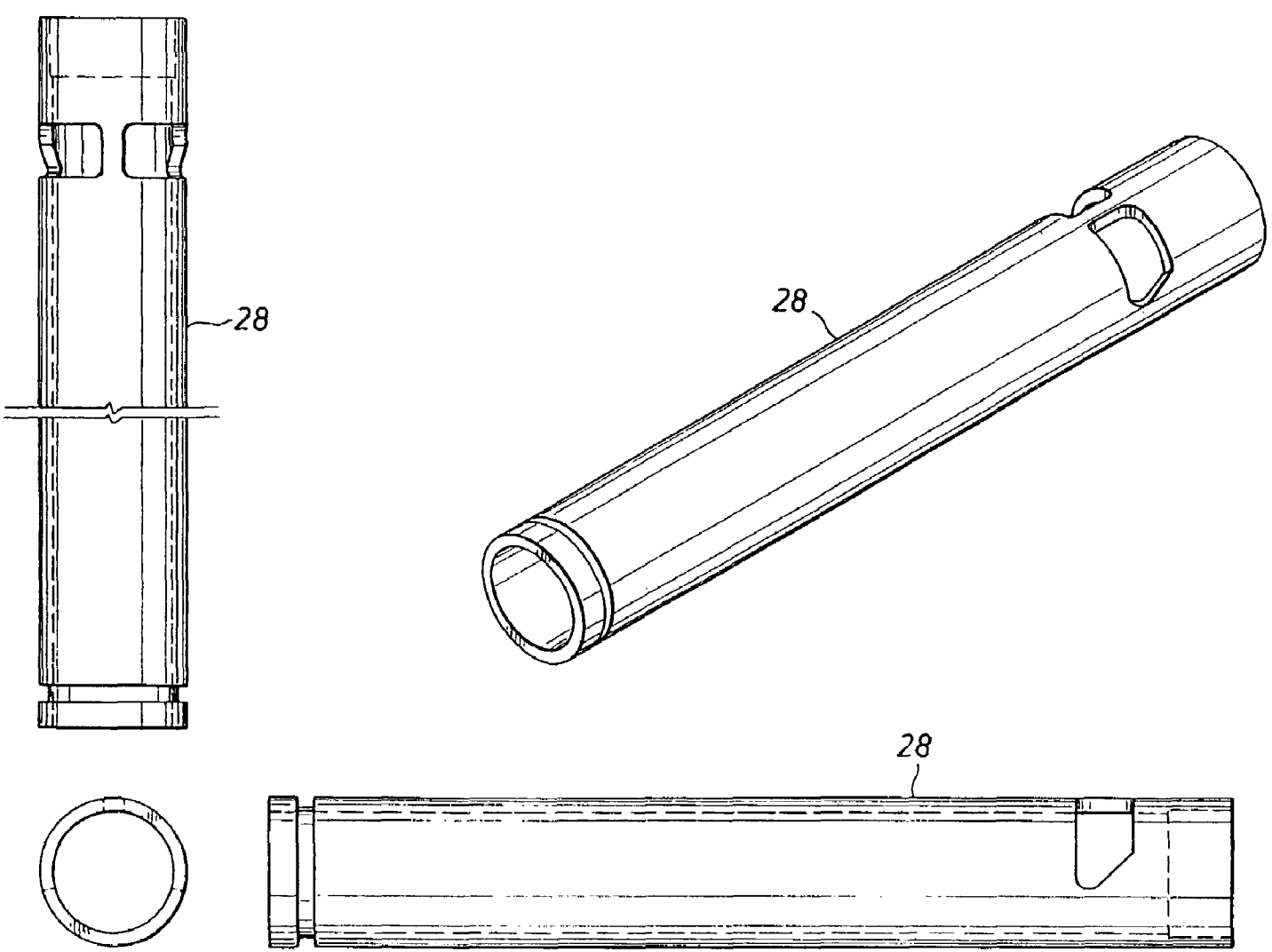

FIGS. 4C and 4D together with 7C and 7D illustrate the low flow and high flow positions for a "ratio selectable" self-metering automatic nozzle which has been rotated to select for a 3% ratio. The metering tube has been rotated such that a different detent, detent 124, located approximately 180 degrees around flow metering tube 96 from detent 120, is in the upper position and meets with detent ball and spring 122. In such position, foam metering tube 96 defines a larger metered foam orifice 94 in both the low flow and high flow positions of foam metering tube 96 in regard to fixed foam tube 28, as illustrated by FIGS. 7C and 7D.

Figures 3, 3A, 4, 5, 6, 7, 8:
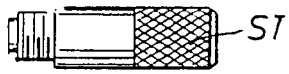
FIGS. 7A, 7B, 7C, 7D, 8 and 9 illustrate a center support/foam tube and a foam metering tube used in a preferred embodiment for a self-metering automatic nozzle to meter for low flow and high flow at two selected ratios.
Figures 1, 3B:
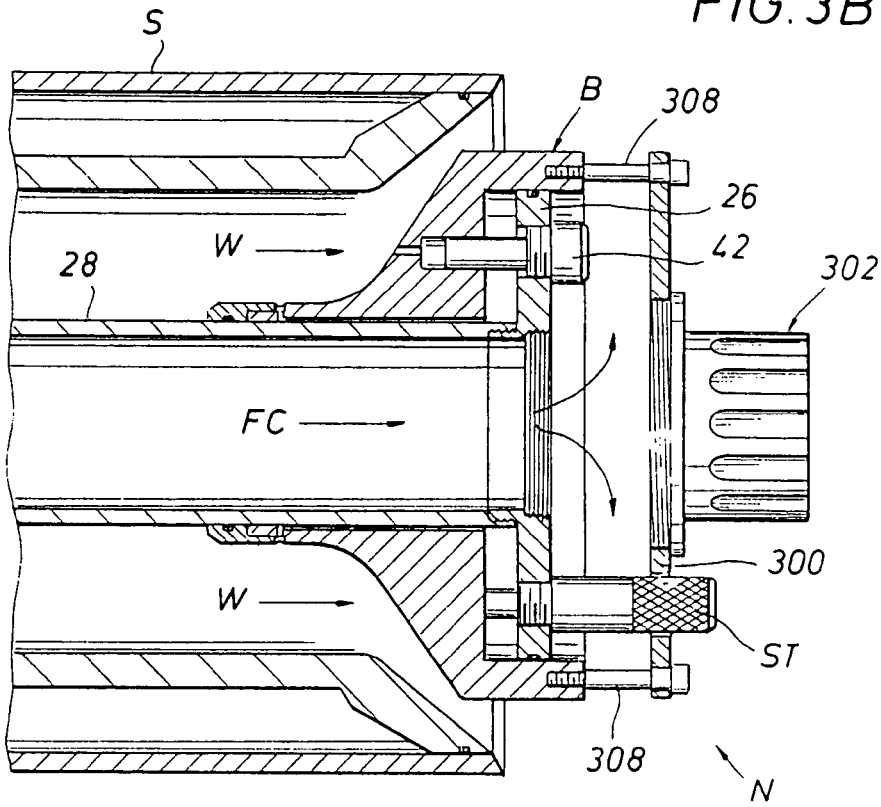
Figures 2, 3B:
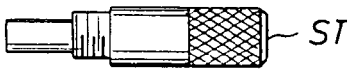
Figures 3, 3B, 4, 5:
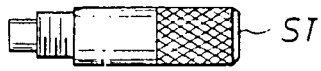
Figures 3, 3B:
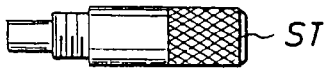
Figures 3, 3B, 4, 5, 6:
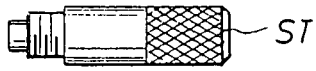
Figures 3, 3B, 4:
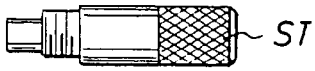
Figures 3, 3B, 4, 5, 6, 7:
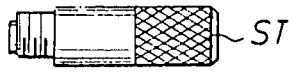
Figure 9:
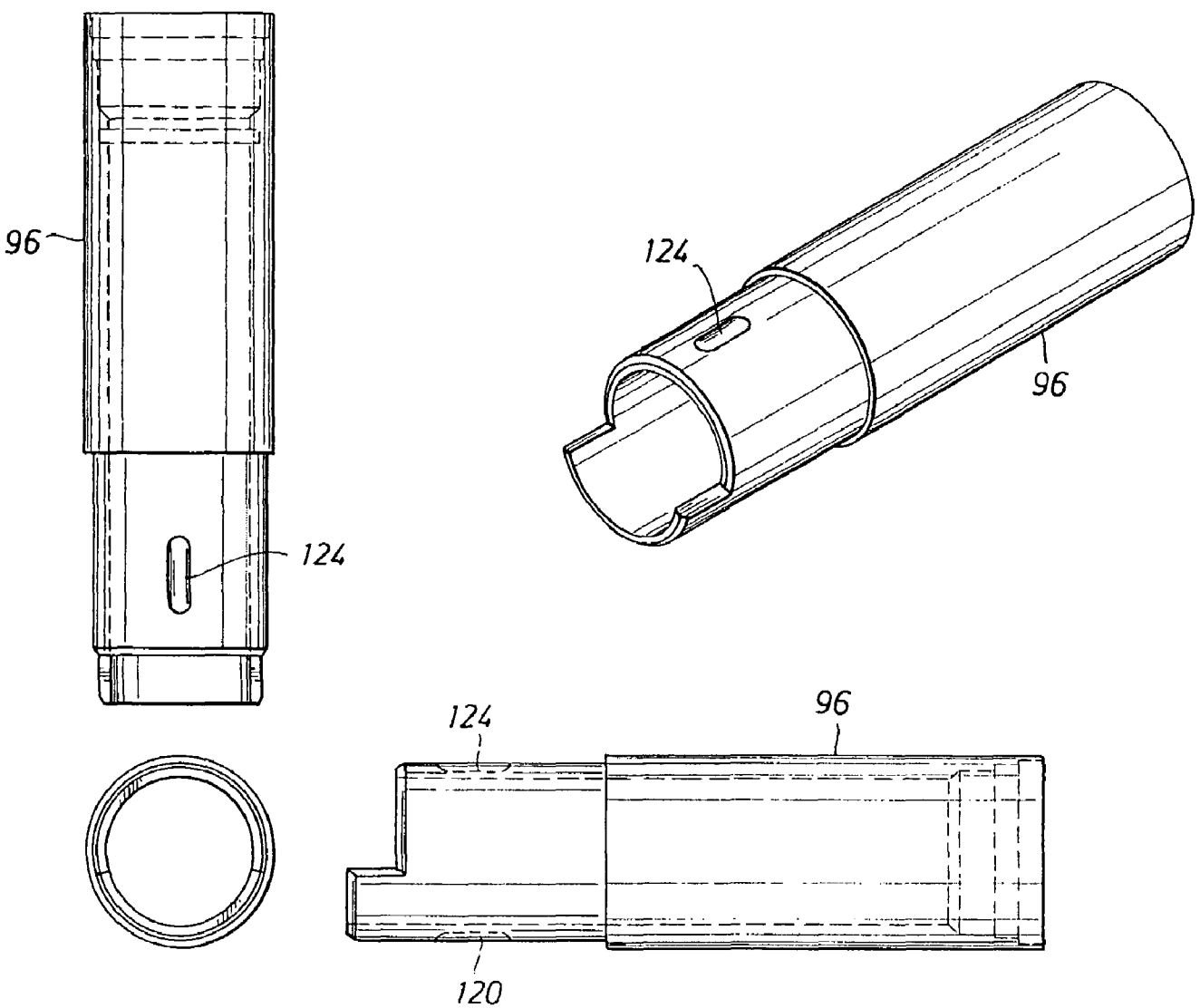

FIGS. 8 and 9 illustrate more clearly the construction of center support foam tube 28, that remains fixed, and foam metering tube 96, that translates around fixed center support foam tube 28, in the preferred embodiment of FIGS. 4 and 7.

FIG. 5 illustrates the incorporation of a mechanical flow meter within the instant design of a self-metering automatic nozzle. The mechanical flow meter includes a following rod 150 attached to rack or gear 152 that is attached to and operates pinion gear 154. Following rod 150 follows translating as incline 156, a part of foam metering tube 96. Incline 156 and biasing means cam the following rod up and down as flow metering tube 96 translates.

Figure 6A:
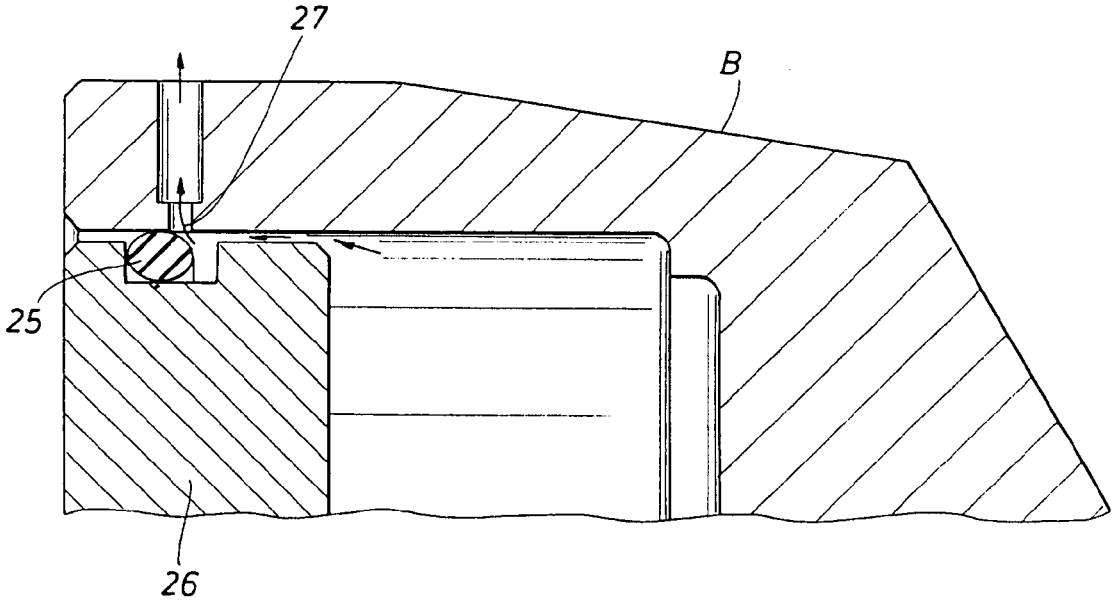
FIGS. 6A and 6B illustrate provision for venting a baffle chamber in an automatic nozzle under low flow conditions.
Figure 6B:
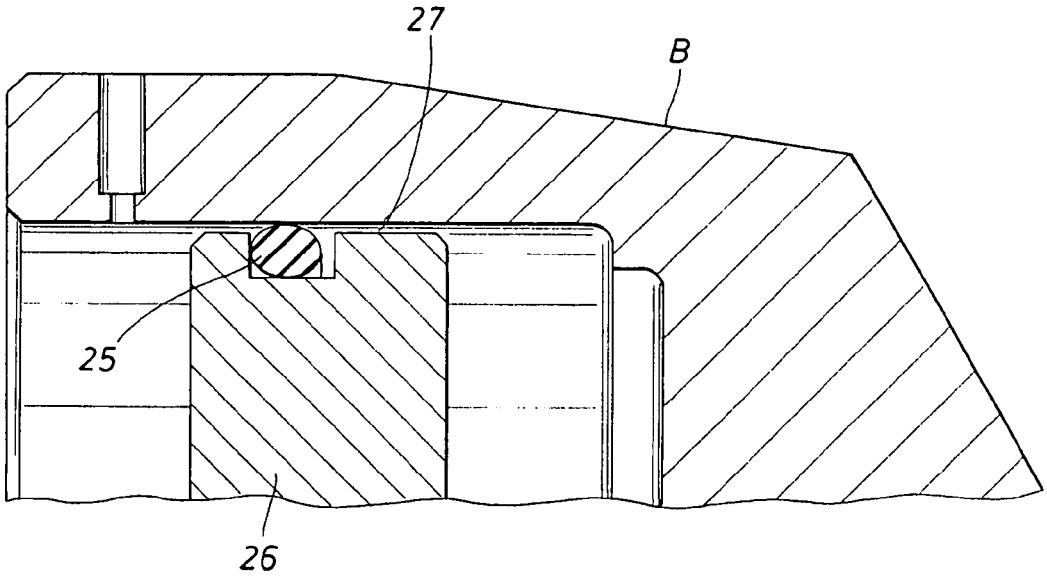

FIGS. 6A and 6B illustrate how piston 26, that rotates with bafflehead B but does not translate with bafflehead B, provides a water vent path 27 that is open in FIG. 6A and closed in FIG. 6B by virtue of o-ring 25 sealing or not sealing against an inside wall of bafflehead B. Providing an open water vent path provides for venting water from the bafflehead chamber when the bafflehead has translated to its lowest flow condition.

While there are shown and described present preferred embodiments of the invention, it is to be distinctly understood that the invention is not limited thereto, but may otherwise variously embodied and practiced within the scope of the following claims.

The foregoing disclosure and description of the invention are illustrative and explanatory thereof, and various changes in the size, shape, and materials, as well as in the details of the illustrated system may be made without departing from the spirit of the invention. The invention is claimed using terminology that depends upon a historic presumptive presentation that recitation of a single element covers one or more, and recitation of two elements covers two or more, and the like.

What is claimed is:

1. A self-metering automatic industrial-scale fire fighting nozzle, comprising:

an additive passageway within the nozzle in fluid communication with a fire-fighting liquid conduit within the nozzle, the conduit having a discharge orifice that varies in size with supply pressure of the liquid, at least for part of a flow range of the nozzle; and structural elements defining a variable opening associated with the additive passageway, the elements structured in combination to automatically vary the opening size in response to variations in size of the discharge orifice.

2. A self-metering automatic industrial-scale fire fighting nozzle, comprising:

an additive passageway within the nozzle in fluid communication with a fire-fighting liquid conduit within the nozzle, the conduit having a discharge orifice that varies in size with supply pressure of the liquid, at least for part of a flow range of the nozzle; and a valve associated with the additive passageway, the valve structured to automatically vary in accordance with variations of the discharge orifice size.

3. A self-metering automatic industrial-scale fire fighting nozzle, comprising:

an additive passageway within the nozzle in fluid communication with a fire-fighting liquid conduit within the nozzle, the conduit having a discharge orifice that varies in size with supply pressure of the liquid, at least for part of a flow range of the nozzle; and means for variably occluding the additive passageway in conjunction with variations of the discharge orifice size.

4. A self-metering automatic industrial-scale fire fighting nozzle, comprising:

an additive passageway within the nozzle in fluid communication with a fire-fighting liquid conduit within the nozzle, the conduit having a discharge orifice that varies in size with supply pressure of the liquid, at least for part of a flow range of the nozzle; and an adjustable opening in the additive passageway calibrated to automatically adjust in response to variations of the discharge orifice size.

5. The nozzle of claim 1 including a ratio selector having at least two settings and wherein the structural elements vary the opening in response to a selector setting.

6. The nozzle of claim 2 including a ratio selector having at least two settings and wherein the valve varies the opening in response to a selector setting.

7. The nozzle of claim 3 including a ratio selector having at least two settings and wherein the means include means for occluding in response to a selector setting.

8. The nozzle of claim 4 including a ratio selector having at least two settings and wherein the opening is calibrated to adjust in response to a selector setting.

9. The nozzle of claims 1, 2, 3, or 4 including:

at least two gap defining elements that relatively adjust to define the discharge orifice of the nozzle; and flow indicator structure that adjusts in tandem with a gap defining element adjustment, the flow indicator structure connected to a visible calibrated indicia of flow.

10. A method, comprising:

automatically metering a preselected ratio of additive into an at least partially automatic industrial-scale fire fighting nozzle, including adjusting at least one occluding element in an additive passageway within the nozzle in fluid communication with a fire fighting liquid conduit within the nozzle in accordance with a varying discharge orifice of the fire fighting liquid conduit.

11. A method, comprising:

automatically metering a preselected ratio of additive into an at least partially automatic industrial-scale fire fighting nozzle, including occluding an additive passageway within the nozzle in fluid communication with a fire fighting liquid conduit within the nozzle in accordance with a varying discharge orifice of the fire fighting liquid conduit.

12. A method, comprising:

automatically metering a preselected ratio of additive into an at least partially automatic industrial-scale fire fighting nozzle, including, in a passageway for additive located inside of the nozzle body, and valving the passageway in tandem with a varying discharge orifice within the fire fighting liquid conduit.

13. The method of claims 10, 11 or 12 that includes selecting between a plurality of additive ratios for the automatic metering.

14. The method of claims 10, 11 or 12 that includes mechanically linking a visible indication of flow rate of fire fighting liquid through the nozzle with the varying fire fighting liquid conduit discharge orifice.

* * * * *